US007445484B2

(12) United States Patent
Wu

(10) Patent No.: US 7,445,484 B2
(45) Date of Patent: Nov. 4, 2008

(54) PLUG CONNECTOR WITH LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/811,852

(22) Filed: Jun. 11, 2007

(65) Prior Publication Data

US 2007/0243749 A1 Oct. 18, 2007

Related U.S. Application Data

(63) Continuation of application No. 11/213,048, filed on Aug. 26, 2005.

(51) Int. Cl.
*H01R 13/627* (2006.01)

(52) U.S. Cl. ..... 439/352

(58) Field of Classification Search ..... 439/160, 439/607–610, 557, 95, 939, 108, 79, 355, 439/577, 620, 82–83, 350, 352–358
See application file for complete search history.

(56) References Cited

U.S. PATENT DOCUMENTS 5,564,939 A 10/1996 Maitani et al.
5,797,771 A 8/1998 Garside
6,165,006 A 12/2000 Yeh et al.
6,585,536 B1 * 7/2003 Wu ..... 439/358
6,648,665 B1 11/2003 Wu
6,659,790 B1 12/2003 Wu
6,709,286 B1 * 3/2004 Korsunsky et al. ..... 439/557
6,749,458 B1 6/2004 Kuo et al.
6,866,533 B2 3/2005 Wu
6,887,091 B1 5/2005 Wu
6,887,101 B2 5/2005 Ito et al.
7,168,987 B1 * 1/2007 Morohoshi et al. ..... 439/608

OTHER PUBLICATIONS

"SFF-8088 Specification for Compact Multilane Series: Shielded" published on Jun. 27, 2005 by SFF Committee.

* cited by examiner

*Primary Examiner*—Edwin A. León
(74) *Attorney, Agent, or Firm*—Wei Te Chung

(57) ABSTRACT

A plug connector includes a housing, a latch member and an actuating member. The housing includes a base portion and a tongue portion extending forwardly from the base portion. The tongue portion has a first surface and is sized to fit within the complementary connector. The base portion has a second surface disposed at a level on the housing that is above the first surface of the tongue portion. The latch member includes an engaging portion attached to the second surface of the base portion and a latching portion extending beyond the base portion and located above the first surface of the tongue portion. The actuating member has an operating portion extending beyond said base portion, a cooperating portion disposed between the latch member and said second surface of the base portion, and an intermediate portion interconnecting the operating portion and the cooperating portion. The actuating member is sized, structured and arranged such that movement of said actuating member away and toward said tongue portion caused the latching portion of the latch member to be raised and lowered relative to the first surface of the tongue portion. The intermediate portion of the actuating member has a portion being sized, structured and arranged such that movement of the actuating member away and toward said tongue portion causing the portion of the intermediate portion to be compressed by the base portion and to provide elastic restoring force to the latching member.

20 Claims, 24 Drawing Sheets

5

PLUG CONNECTOR WITH LATCHING MECHANISM

CROSS-REFERENCE TO RELATED APPLICATIONS

This application is a CA (Continuation Application) of U.S. patent application Ser. No. 11/213048 filed on Aug. 26, 2005 and entitled "PLUG CONNECTOR WITH EMI GASKET", and closely related to U.S. Pat. No. 7,134,914 and entitled "CABLE CONECTOR ASSEMBLY WITH LATCHING MECHANSIM", both of which have the same applicant and assignee as the present invention.

BACKGROUND OF THE INVENTION

1. Field of the Invention

The present invention generally relates to a plug connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a plug connector connecting with the small-size drive and a header mounted on the printed circuit board. The plug connector defined in the specification comprises a pair of engagble metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and an actuating member cooperating with the latch member for actuating the latch member to separate from the header. The latch member is assembled to a rear portion of a base of the upper housing with latch portion exposed beyond a front portion of the base of the upper housing to locate above a tongue portion of the upper housing. However, such elongated latch member is hard to be actuated by the actuating member, otherwise the latch member must have enough thickness or made by high-quality material having enough rigidity to achieve the goal of latching reliably and unlatching easily.

Hence, an improved plug connector is provided in the present invention to address the problems mentioned above and meet the current trend.

BRIEF SUMMARY OF THE INVENTION

Accordingly, an object of the present invention is to provide a plug connector with latch mechanism for achieving perfect signal transmission effect.

In order to achieve the above-mentioned object, a plug connector in accordance with the present invention comprises a housing, a latch member and an actuating member. The housing comprises a base portion and a tongue portion extending forwardly from the base portion. The tongue portion has a first surface and is sized to fit within the complementary connector. The base portion has a second surface disposed at a level on the housing that is above the first surface of the tongue portion. The latch member comprises an engaging portion attached to the second surface of the base portion and a latching portion extending beyond the base portion and located above the first surface of the tongue portion. The actuating member has an operating portion extending beyond said base portion, a cooperating portion disposed between the latch member and said second surface of the base portion, and an intermediate portion interconnecting the operating portion and the cooperating portion. The actuating member is sized, structured and arranged such that movement of said actuating member away and toward said tongue portion caused the latching portion of the latch member to be raised and lowered relative to the first surface of the tongue portion. The intermediate portion of the actuating member has a portion being sized, structured and arranged such that movement of the actuating member away and toward said tongue portion causing the portion of the intermediate portion to be compressed by the base portion and to provide elastic restoring force to the latching member.

Other objects, advantages and novel features of the invention will become more apparent from the following detailed description of the present embodiment when taken in conjunction with the accompanying drawings.

DETAILED DESCRIPTION OF THE INVENTION

Figure 1:
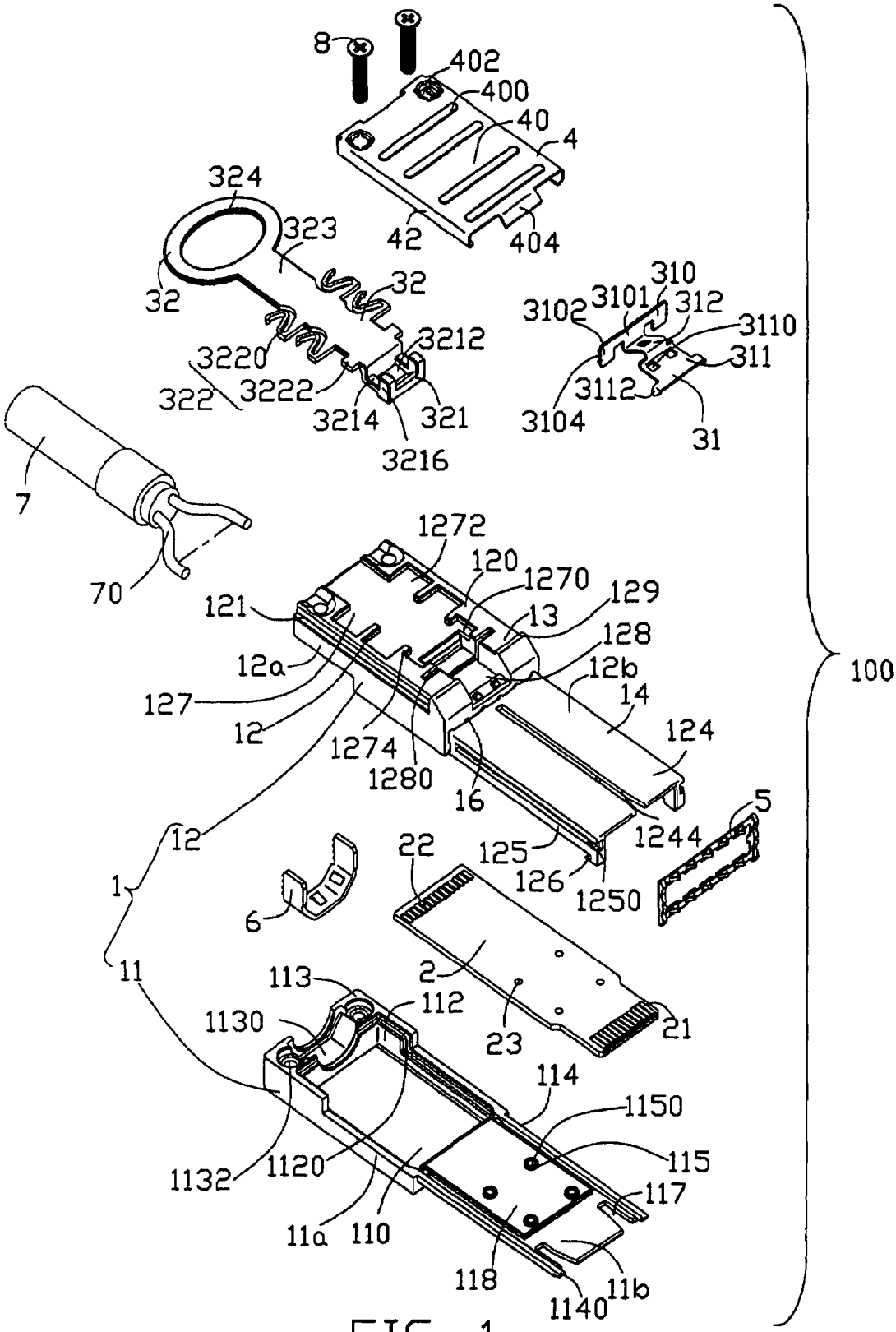
FIG. 1 is an exploded, perspective view of a plug connector in accordance with the first embodiment of the present invention.
Figure 2:
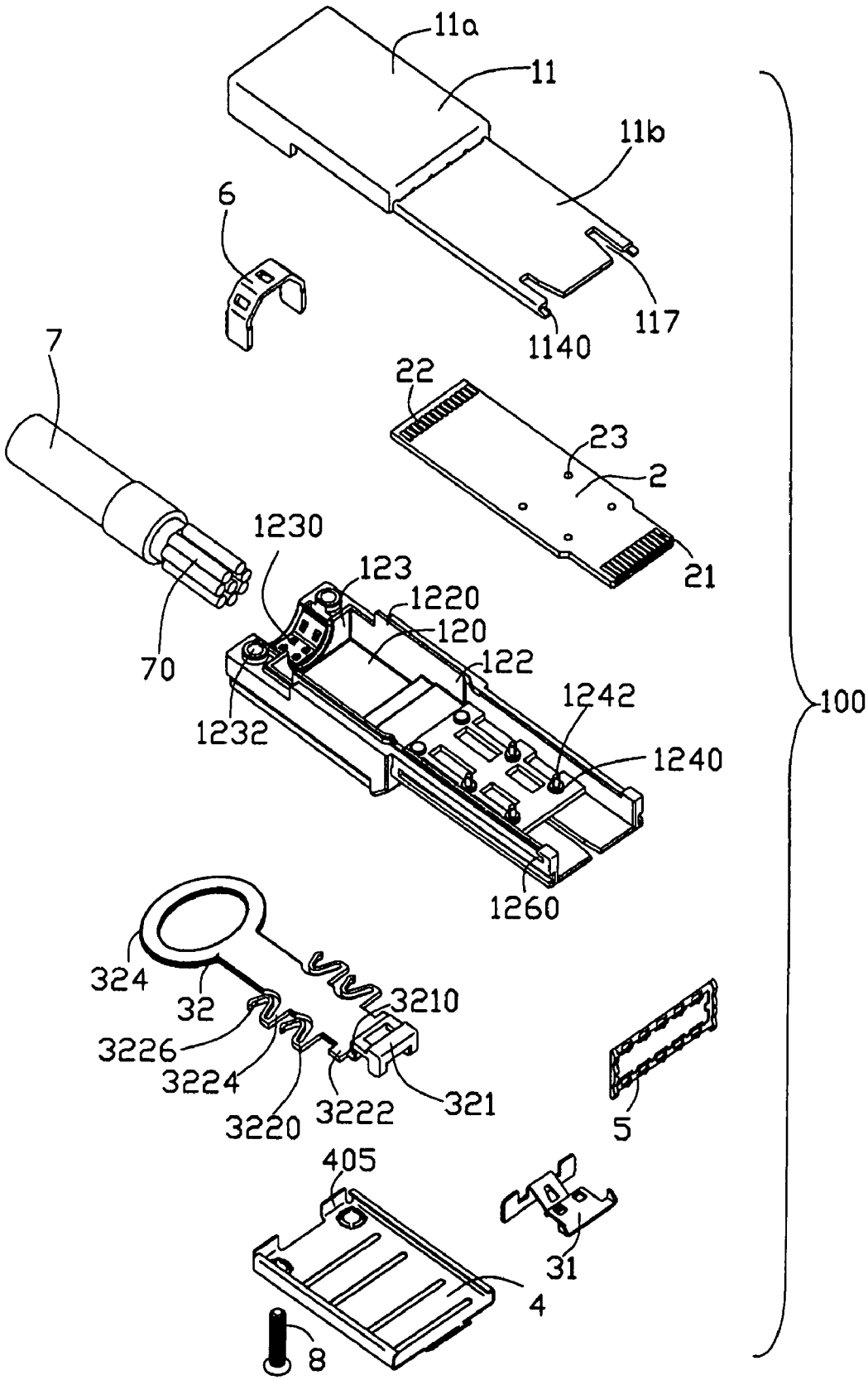
FIGS. 2-4 are views similar to FIG. 1, but viewed from different angles.
Figure 3:
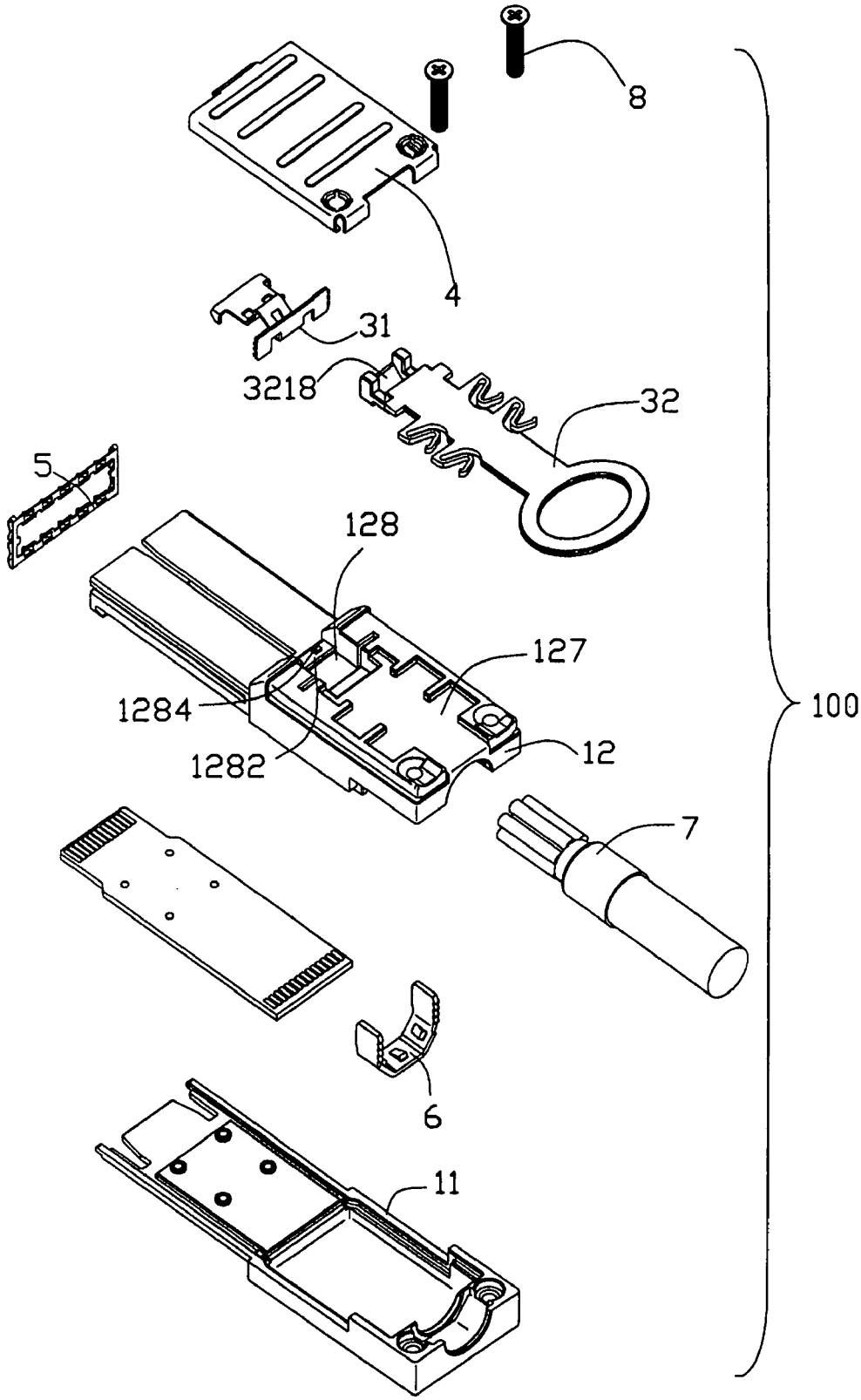
Figure 4:
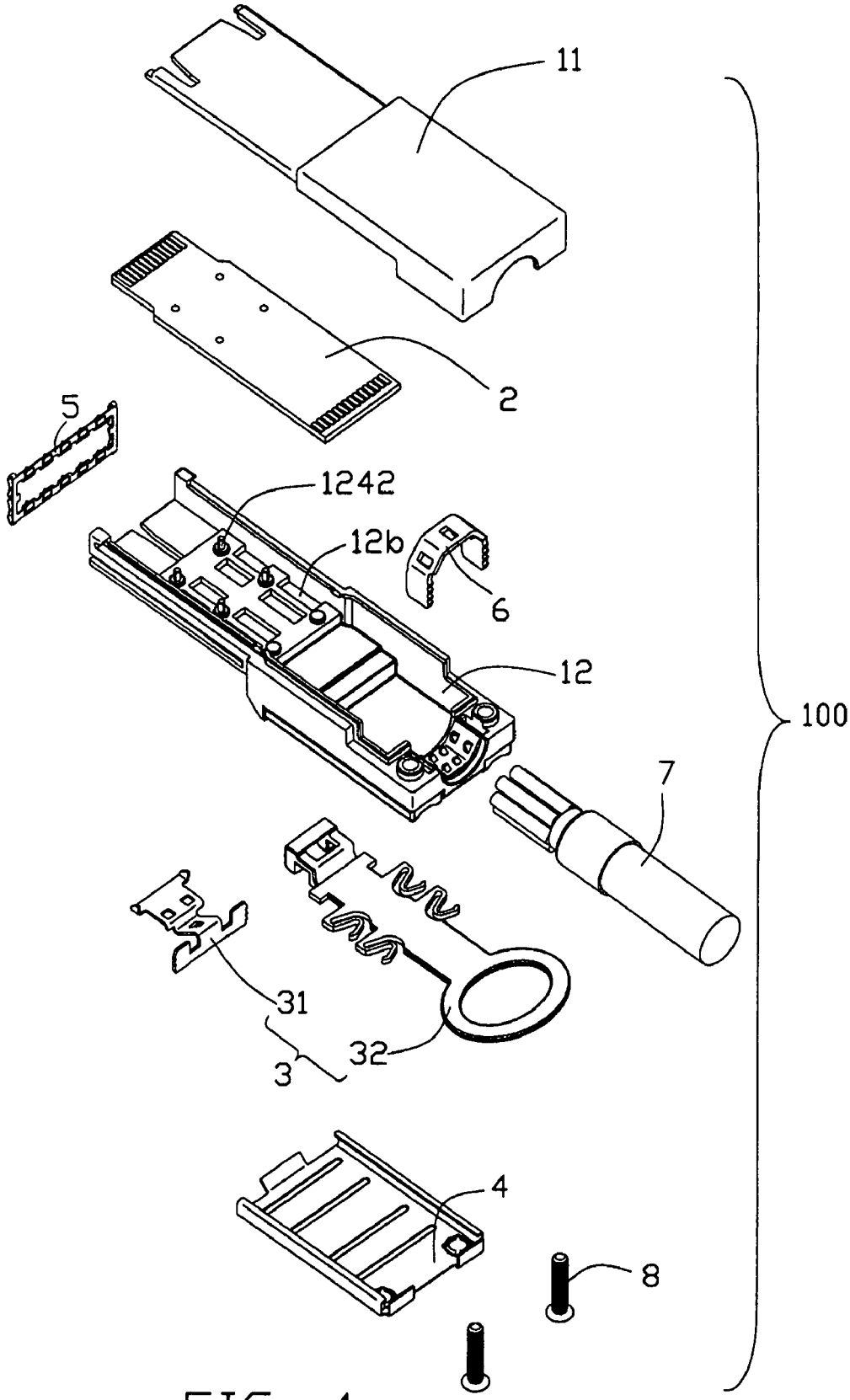
Figure 5:
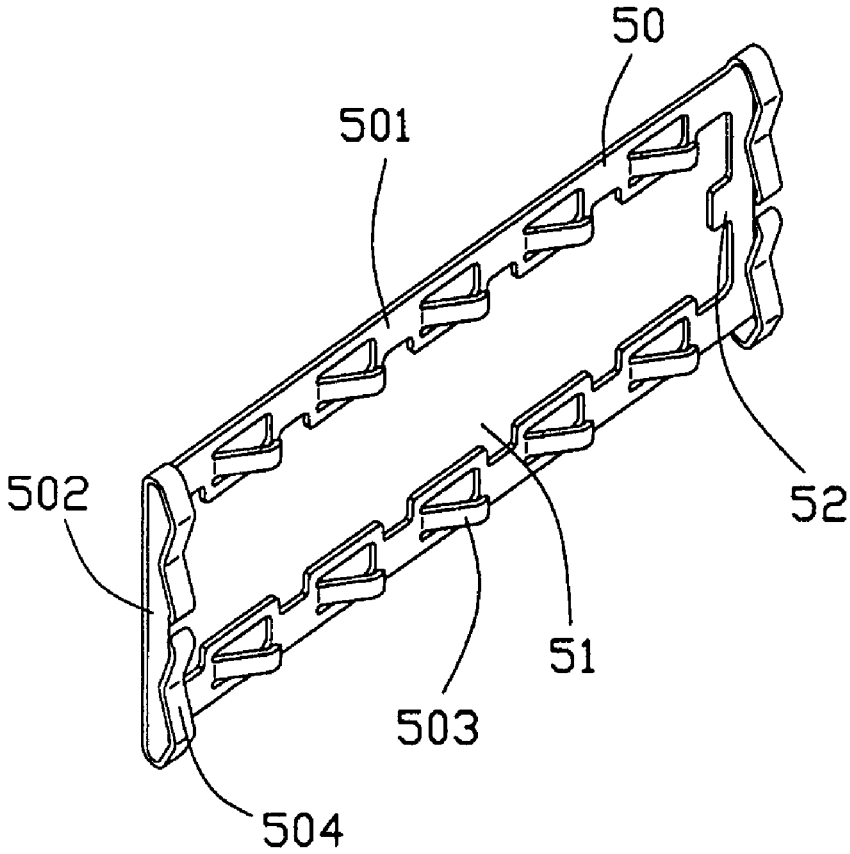
FIG. 5 is an enlarged view of a gasket of the plug connector of FIG. 1.

Reference will now be made to the drawing figures to describe the present invention in detail.

Referring to FIGS. 1-4, a plug connector 100 in accordance with the first embodiment of the present invention comprises a housing 1, a printed circuit board (PCB) 2 located in the housing 1, a cable 7 with a cable holder 6 electrically connecting with the PCB 2, a latch mechanism 3 assembled to the housing 1, a metal shell 4 assembled to the housing 1 to partially cover the latch mechanism 3.

Please refer to FIGS. 1-8, the housing 1 of the present invention is made of metal material and comprises a base 11, a cover 12 engagble with the base 11 and a receiving space 15 formed between the base and the cover 11, 12. The metal housing 1 also comprises a rectangular base portion 13 and an elongated tongue portion 14 extending forwardly from the base portion 13.

The base 11 comprises a first base section 11*a* and a first tongue section 11*b* extending forwardly from the first base section 11*a*. The first base section 11*a* comprises a first flat portion 110, a pair of first flanges 112 and a first rear wall 113 extending upwardly from opposite side edges and rear edge of the first flat portion 110. The front portions of the first flanges 112 are cut to present the first flanges 112 L-shaped. A first substantially semicircular opening 1130 is defined in the first rear wall 113 and a pair of first screw holes 1312 are defined in the first rear wall 113 and located at opposite sides of the first semicircular opening 1130. A first slit 1120 extends downwardly from a top surface of the first base section 11*a* and into the first flanges 112 and a front portion of the first rear wall 113. The first tongue section 11*b* comprises a first panel 118 formed with a pair of ribs 114 located at opposite sides thereof. Each rib 114 forms a tip end 1140 extending beyond a front edge of the flat portion 118. The first panel 118 also forms two pairs of first standoffs 115 spaced arranged thereon, and each first standoff 115 defines a first positioning hole 1150 therein. A pair of U-shape cutouts 117 extend rearward from the front edge of the first panel 118 and respectively locate adjacent to corresponding ribs 1140.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. The rear portions of the second flanges 122 and the second rear wall 123 are cut to present the second flanges 122 L-shaped. A second substantially semicircular opening 1230 is defined in the second rear wall 123. A pair of second screw holes 1232 are defined through the second rear wall 123 and locate at opposite sides of the second semicircular opening 1230. Corresponding to the first slit 1120 of the base 11, a continuous protruding ridge 1220 integrally extend downwardly from inner edges of the second flanges 122 and the second rear wall 123. The second flat portion 120 defines a first recess section 127 consisting of different-size first and second recesses 1270, 1272, and a deeper and narrower second recess section 128 formed in a front portion of the second flat portion 120 to communicate with a front surface of the second flat portion 120. A deeper slit 1280 is defined in the front portion of the second flat portion 120 and extends in a direction perpendicular to that of the second recess section 128 to communicate with the second recess section 128. A transversely-extending bar 1282 is formed at a front end of the second recess section 128 with a pair of projections 1284 arranged thereon. A pair of first channels 121 are respectively defined in opposite sides of the first flat portion 12*a* extending in a back-to-front direction. A pair of rims 129 are formed at the front portion of the first flat portion 12*a*.

The second tongue section 12*b* comprises a second panel 124 formed with a long keyway 1244 and a pair of side walls 125 extending downwardly from opposite sides of the second panel 124. A pair of second channels 1250 are defined in corresponding side walls 125 opened toward outside for guiding an insertion of a complementary connector (not shown). A pair of protrusions 126 extend rearward from a front surface of the second tongue section 12*b* and respectively locate below the side walls 125 to form a pair of gaps 1260 therebetween. The second panel 124 forms a enhancing portion (not labeled) on a bottom surface thereof for enhancing the strength thereof and three pairs of second standoffs 1240 are symmetrically arranged on the enhancing portion with two pairs of second standoffs 1240 formed with posts 1242 extending downwardly. The first and second standoffs 115, 1240 with the first and second positioning holes 1150, 1242 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the PCB 2. Two pairs of holes 23 served as are symmetrically arranged on the PCB 2 adjacent to the first conductive pads 21. The holes 23 are served as second engaging means of the PCB 2. The second engaging means is also not limited to the structures described above, it can be standoffs with holes to receive the respective protrusions of the first engaging means of the housing 1, or different-shape projections formed on opposite surfaces of the PCB to be received in the recesses of the first engaging means of the housing 1.

The latch mechanism 3 comprises a latch member 31 latching with the complementary connector and an actuating member 32 cooperating with the latch member 31 to actuate the latch member 31 to unlatch from the complementary connector.

The latch member 31 is made of metal material and is a cantilever-type member. The latch member 31 comprises a N-shape engaging portion 310 located in a vertical surface, a flat latching portion 311 located in a horizontal surface perpendicular to the vertical surface and an inclined connecting portion 312 connecting the engaging portion 310 with the latching portion 311 to provide spring force to the latch member 31. The engaging portion 310 comprises a transverse bar section 3101 and a pair of side sections 3102 extending downwardly from opposite sides of the bar section 3101. Each side section 3102 is formed with barbs 3104 on outmost edge thereof. The flat latching portion 311 defines a pair of rectangular holes 3110 at a rear portion thereof adjacent to the connecting portion 312 and a pair of latches 3112 bending downwardly from opposite sides of the front edge thereof. The connecting portion 312 connects with middle portion of the bar section 3101 and extends upwardly from a lower edge of the bar section 3101. The connecting portion 312 also defines a hole therein for adjusting spring force of the latch member 31 through changing size and shape of the hole.

The actuating member 32 is made by insulative material and comprises a cooperating portion 321, an elongated intermediate portion 323 extending rearward form the cooperating portion 321 and formed with interference portion 322, and a ring-shape operating portion 324 formed at a rear end of the intermediate portion 323. The interference portion 322 comprises a pair of stop sections 3212 formed at opposite sides of the intermediate portion 323 and located adjacent to the cooperating portion 321 and two pairs of elastic sections 3210 formed at middle portion of the intermediate portion 323. Each elastic section 3210 comprises a transverse block section 3224 and a V-shape spring section 3226 extending rearward from the block section 3224. The cooperating portion 321 comprises a vertical section 3210 connecting the cooperating portion 321 with the intermediate portion 323 and a body section 3212 extending forwardly from a lower edge of the vertical section 3210. The body section 3212 forms a pair of upwardly extending ribs 3214 with tip end formed with enlarged protrusions 3216. A slanted surface 3218 downwardly and rearward extends from a front surface of the body section 3212.

The conductive shell 4 comprises a body portion 40 formed with a plurality of bars 400 on a top surface for increasing friction and a pair of L-shape lateral walls 42 extending downwardly from opposite sides of the body portion 40. A pair of holes 402 and a downwardly-extending first tab 404 are respectively formed in a rear portion and a front edge of the body portion 40. A pair of second tabs 405 are formed with the body portion 40 extending downwardly from a rear edge of the body portion 40.

Figure 13:
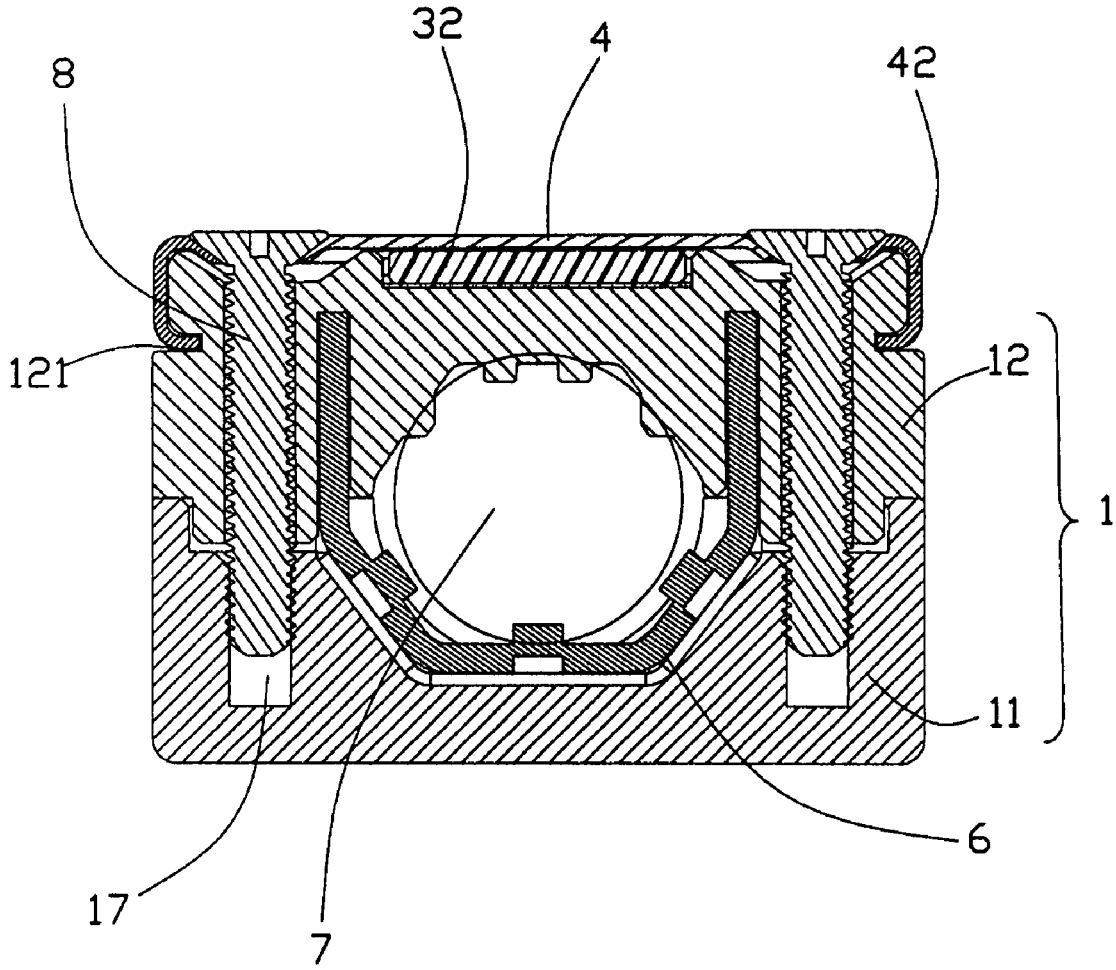
Figure 14:
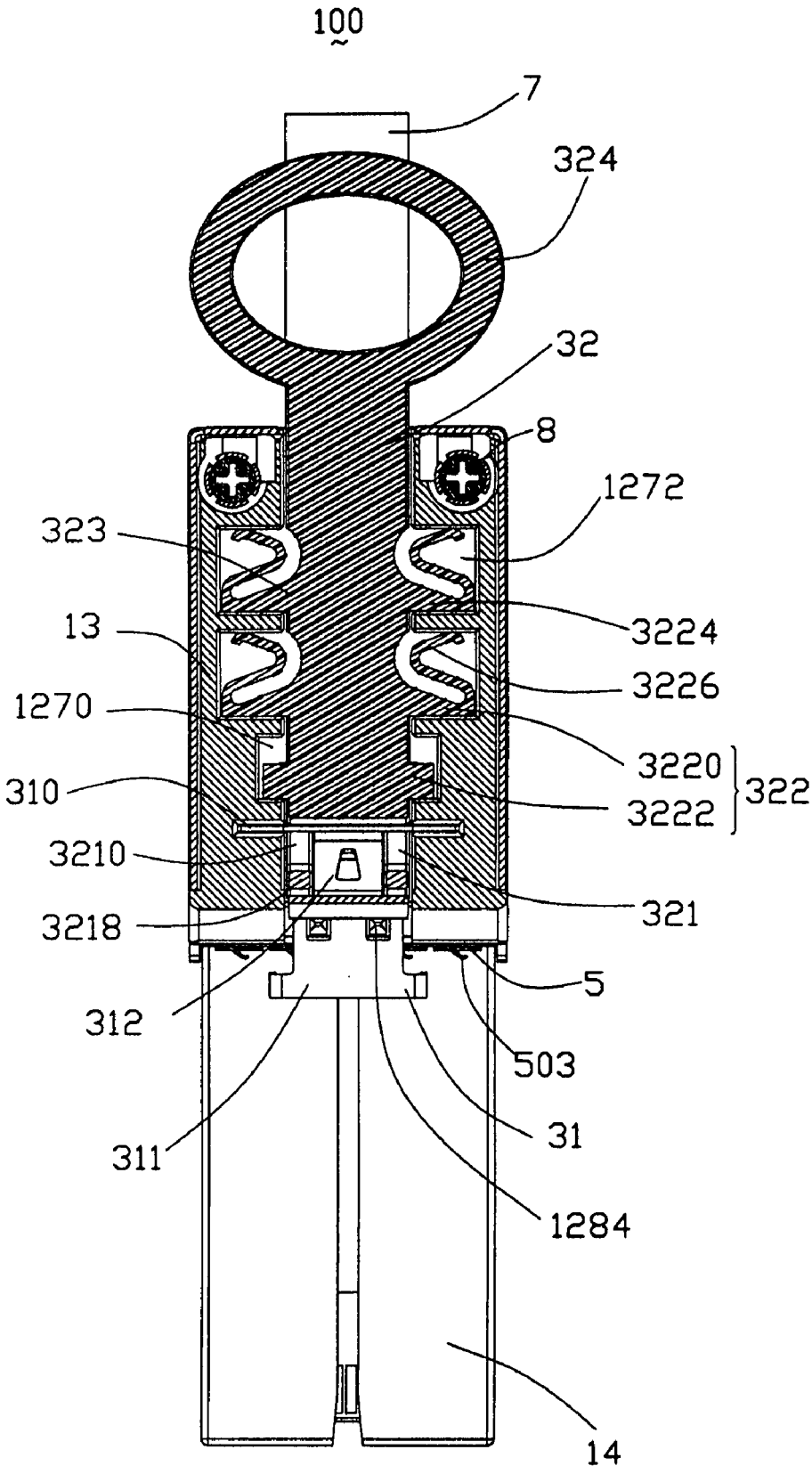

In assembly, conductors 70 of the cable 7 are respectively soldered to the second conductive pads 22 of the PCB 2. The PCB 2 with the cable 7 is located on the first standoffs 115 of the base 11 with the holes 23 aligned with the first positioning holes 1150 and the cable 7 is located in the first semicircular opening 1130 of the base 11. The plug connector 100 of the present invention may have a cable holder 6 grasping a metal braiding area exposed outside of the cable 7 to provide strain relief to the cable 7. The cover 12 is assembled to the base 11 and the PCB 2 with the posts 1242 protruding through the holes 23 and the first positioning holes 1150 to position the PCB 2 in the receiving space 15 of the housing 1. The PCB 2 is sandwiched between the base 1 and the cover 12 by the first and second engaging means engaging with each other. The protruding ridge 1220 of the cover 12 is received in the first slit 1120 of the base 11 and the pair of tip ends 1140 received in the gaps 1260, thus, the base 11 and the cover 12 are also securely assembled together. The first and second screw holes 1132, 1232 combine into a screw receiving space 17 (FIG. 13).

Figure 6:
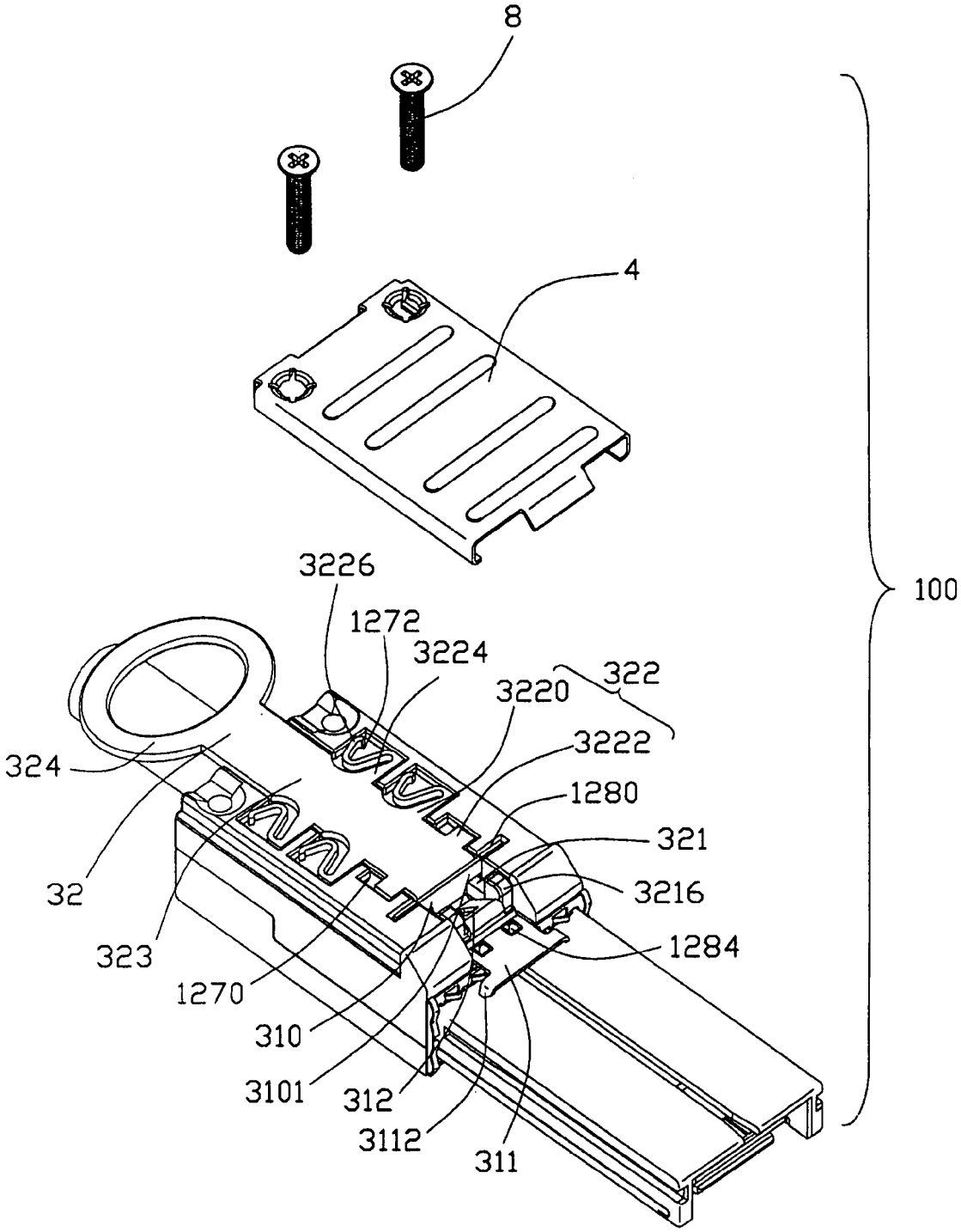
FIG. 6 is a partially assembled view of the plug connector of FIG. 1.
Figure 7:
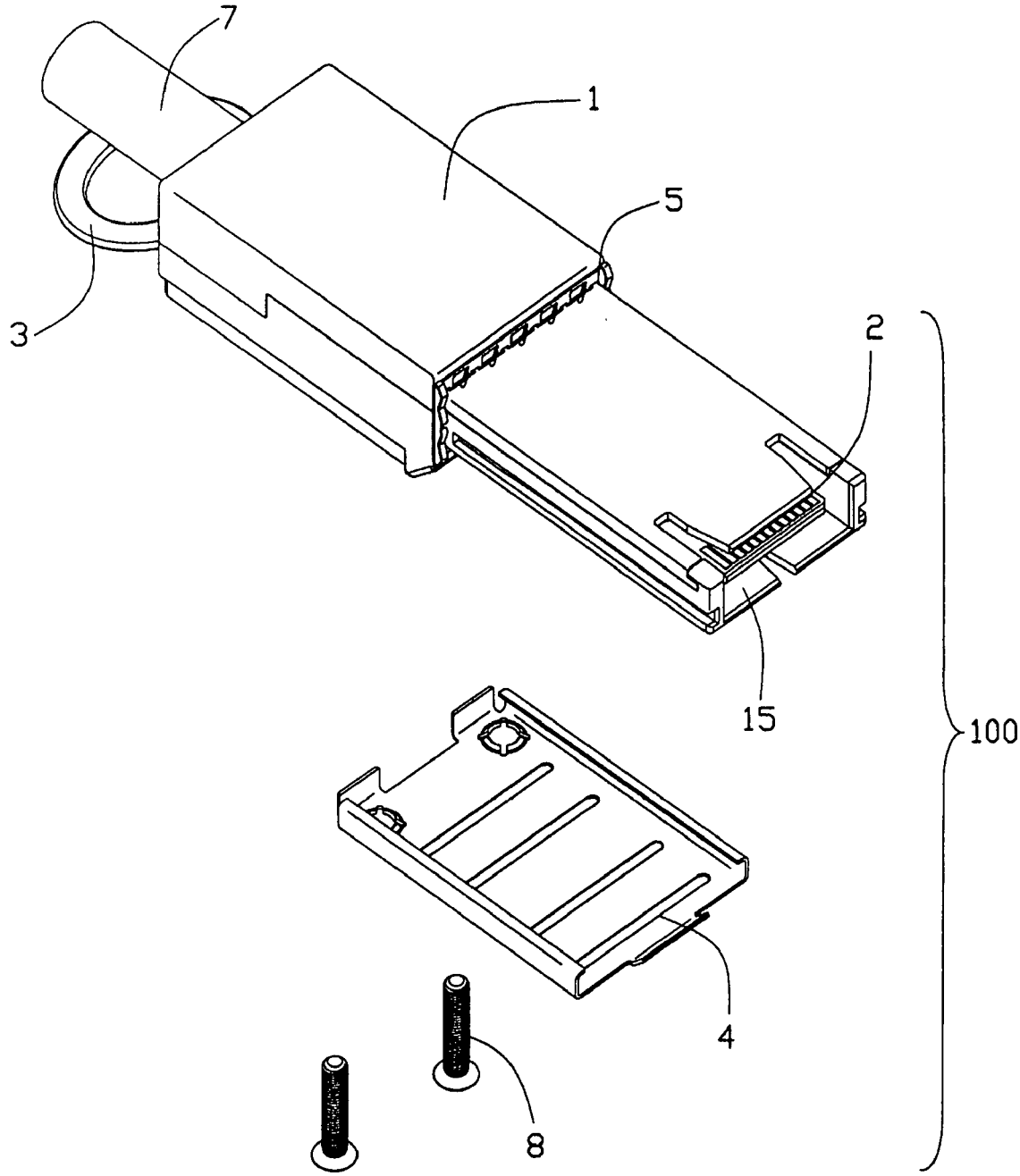
FIG. 7 is a view similar to FIG. 6, but viewed from a different angle.
Figure 8:
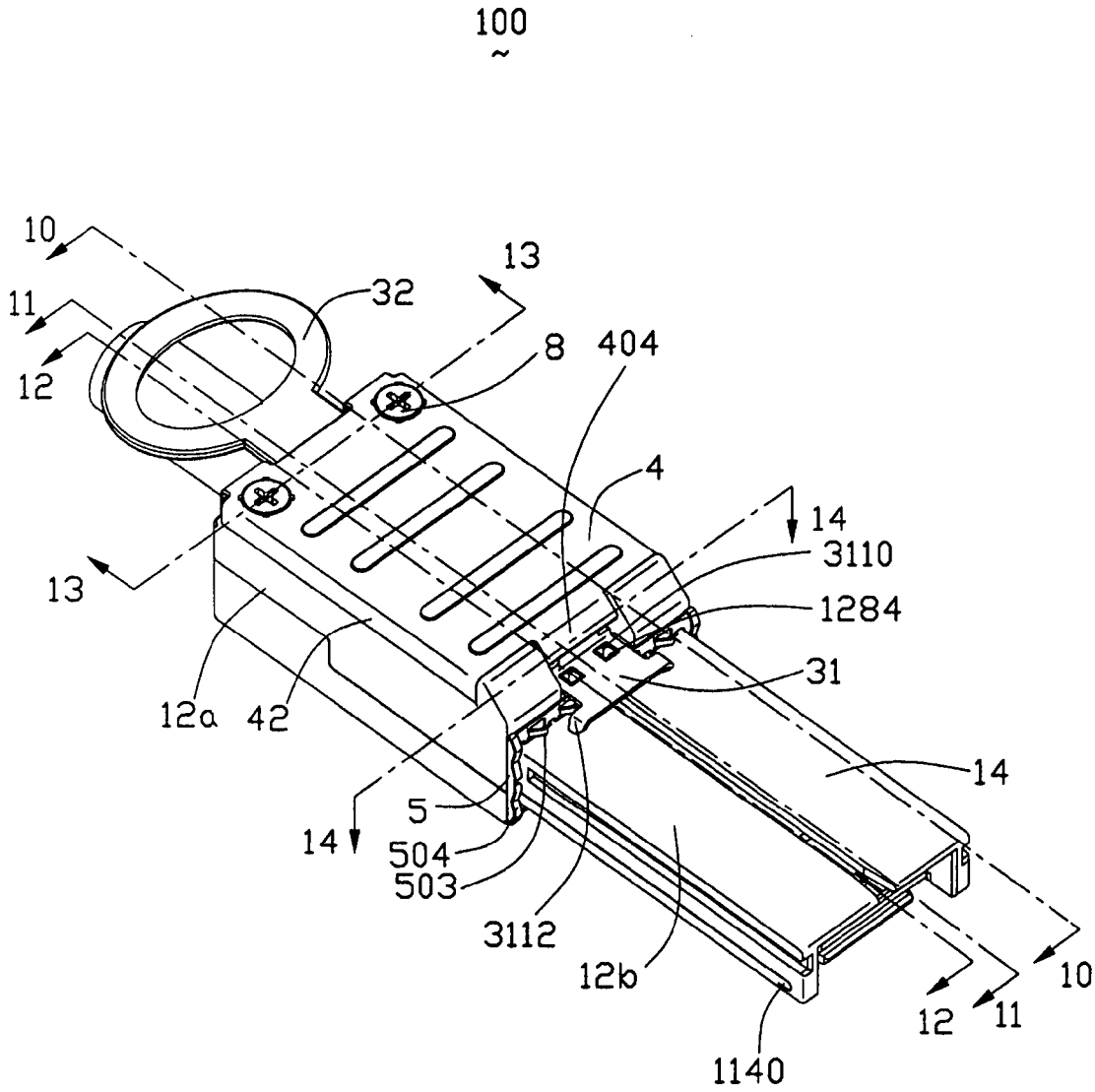
FIG. 8 is an assembled view of the plug connector of FIG. 1.
Figure 9:
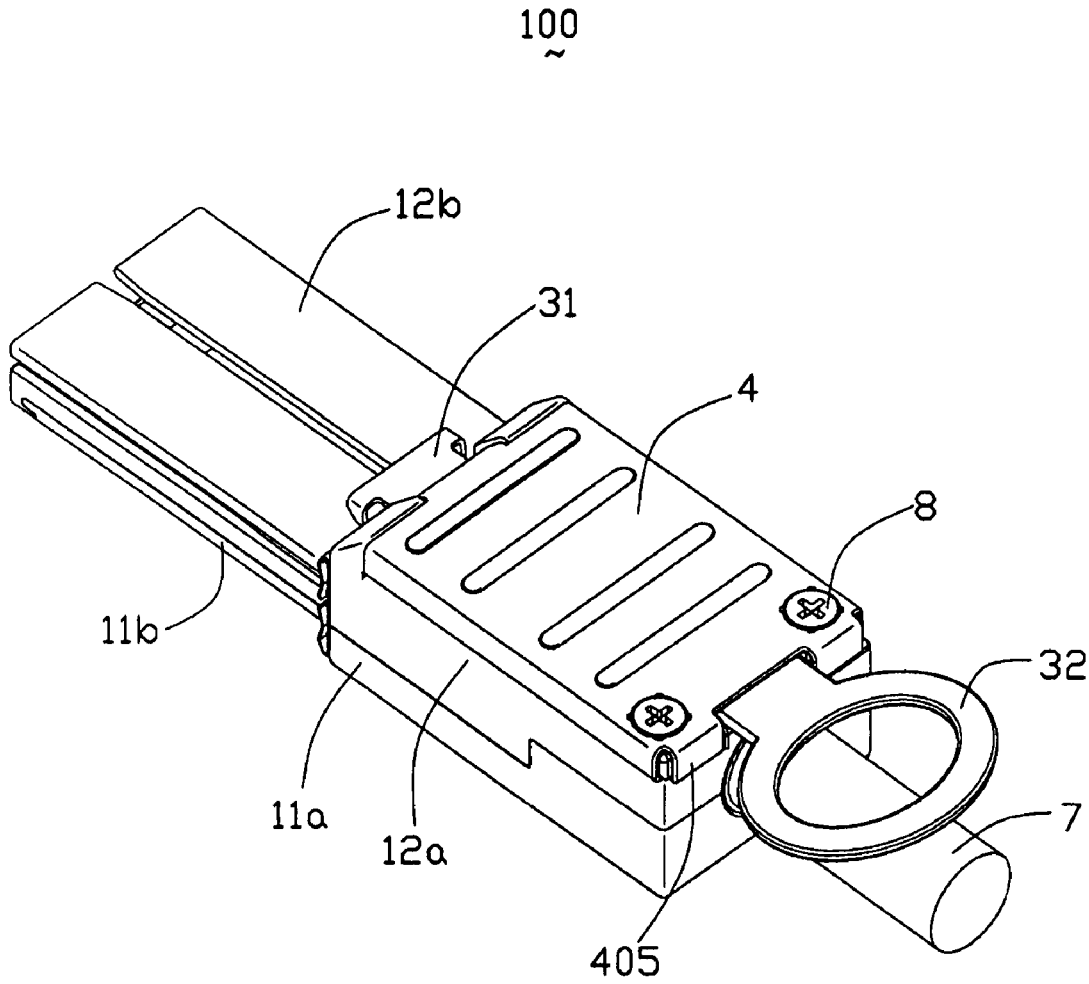
FIG. 9 is a view similar to FIG. 8, but viewed from a different angle.
Figure 10:
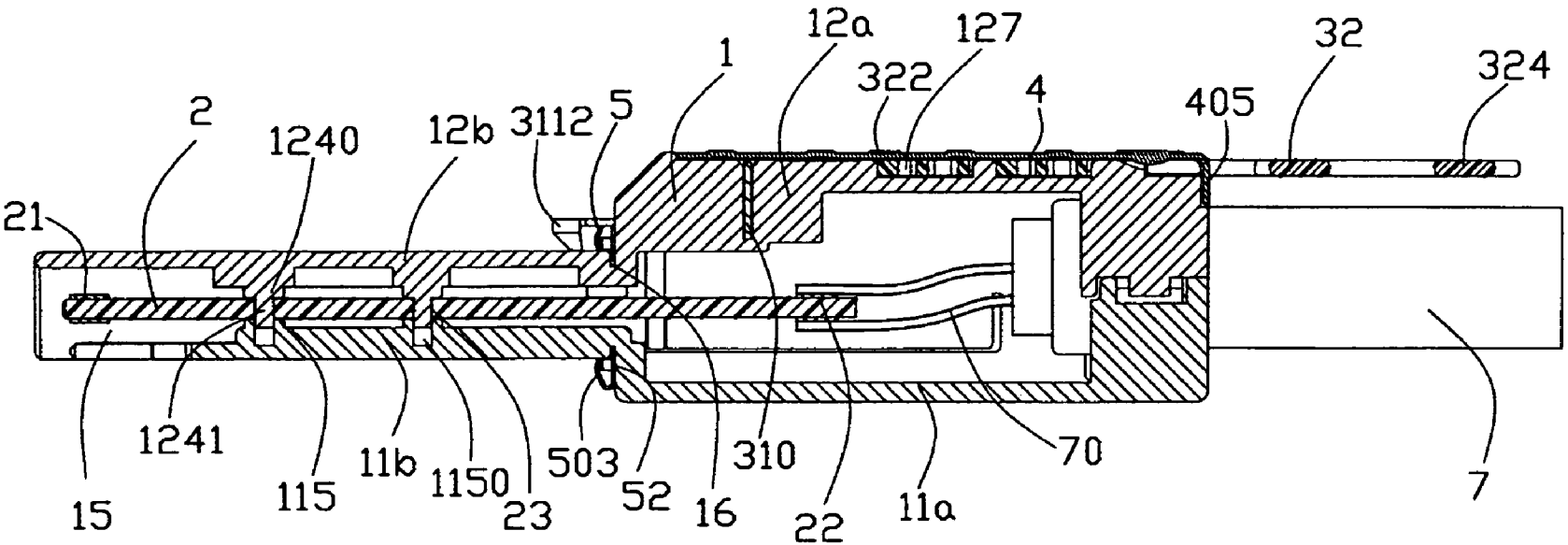
FIGS. 10-14 are cross-section views taken along lines 10-10 to 14-14 of FIG. 8.
Figure 11:
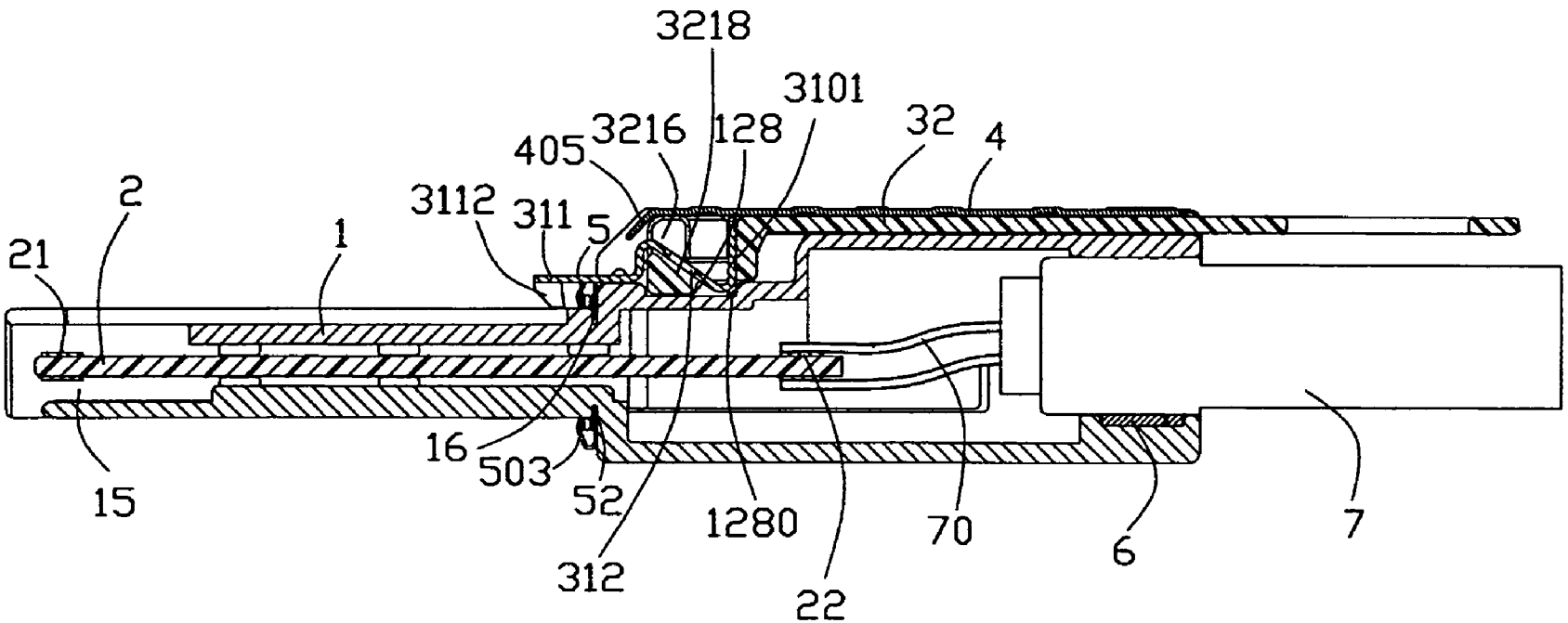
Figure 12:
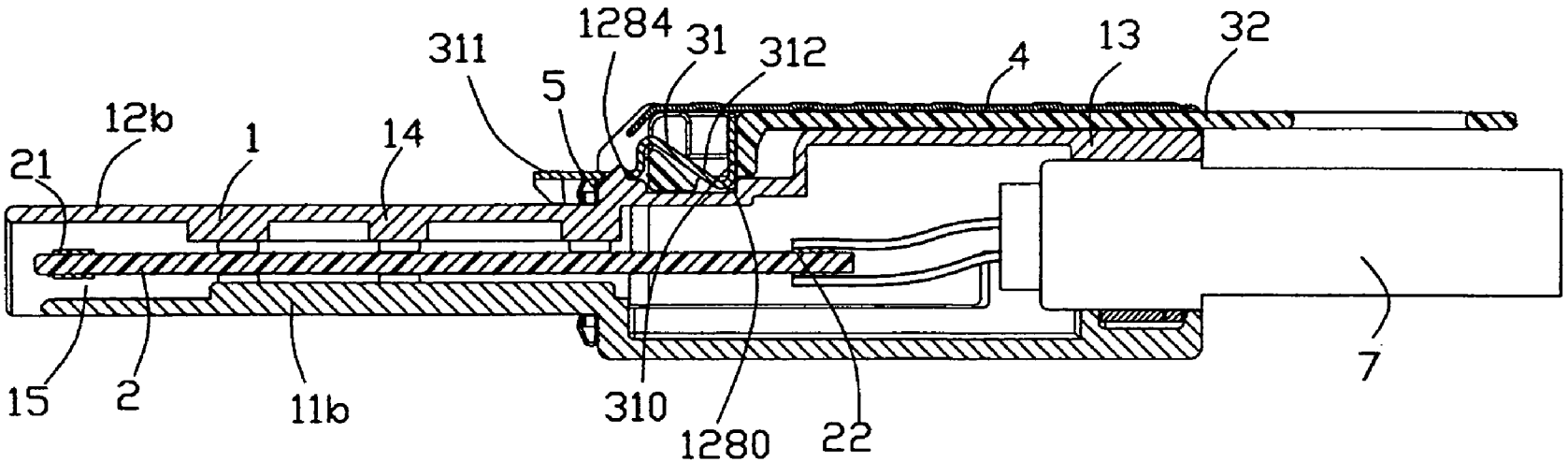

Referring to FIG. 6 in conjunction with FIGS. 11-14, the latch mechanism 3 is assembled to the second base section 12*a* of the cover 12 along a vertical direction perpendicular to the front-to-back direction. The actuating member 32 is firstly pressed to the cover 12. The cooperating portion 321 of the actuating member 32 is received in the second recess section 128 of the cover 12, and the intermediate portion 323 with the interference portion 322 are received in the first recess section 127. The stop sections 3222 and the elastic sections 3220 are respectively sliderably received in the different-size first and second recesses 1270, 1272 with the block section 3224 and spring section 3226 respectively abutting against opposite edges of the large-size second recesses 1272. The latch member 31 is assembled to the cover 12 along the vertical direction and the engaging portion 310 is interferentially received in the slit 1280. The inclined connecting portion 312 is located on the slanted surface 3218 of the body section 3212 of the cooperating portion 321. The bar section 3101 of the latch member 31 are located on the ribs 3214 with the enlarged protrusions 3216 located in front of the bar section 3101. The projections 1284 of the cover 12 are respectively received in the rectangular holes 3110 and the latches 3112 exposed above the second tongue section 12*b*.

When the complementary connector mates with the plug connector 100 of the present invention, contacts of the complementary connector may electrically connect with the first conductive pads 21 of the PCB 2 with corresponding structure thereof latches with the latches 3112 of the latch member 31. When the plug connector 100 disengages from the complementary connector, a rearward pulling force exerts to the operating portion 324 of the actuating member 31 to actuate the actuating member 32 rearward move with the elastic sections 3220 and the stop sections 3222 sliding in the second and first recesses 1272, 1270 until the enlarged protrusions 3216 abut against the bar section 3101 of the latch member 31. The body section 3212 also rearward moves with the slanted surface 3218 sliding along a bottom periphery of the inclined connecting portion 312, thus actuating the connecting portion 312 to pivot upwardly relative to the bar section 3101 of the engaging portion 310 and the latch section 311 with the latches 3112 to upwardly move to unlatch from the complementary connector. After the rearward pulling force is removed, restore force of the elastic sections 3220 actuates the actuating member 32 to move forwardly to its original position, and thus, the latch member 31 also reverts to its original position.

The conductive shell 4 is finally assembled to the second base section 12*a* of the cover 12 with the L-shape lateral walls 42 sliderably received in the first channels 121 of the cover 12 along a back-to-front direction until a front edge of the conductive shell abuts against the rims 129. The first tab 404 is received in the second recess section 128 of the cover 12 and the second tabs 405 respectively locate on steps formed on rear edge of the cover 12. The first tab 404 also presses on the latch member 31 to provide extra return force to the latch member 31 when disengaging the plug connector 100 from the complementary connector. A pair of screws 8 are screwed through the holes 402 of the shell 4, the second screw holes 1232 of the cover 12 and the first screw holes 1132 of the base 11 to retain the shell 4 with the base 11 and the cover 12.

The metal housing 1 may define a plurality of splits 16 spaced arranged on the tongue portion 14 adjacent to the front surface of the base portion 13. The plug connector 100 of the present invention may have an EMI gasket 5 assembled to the metal housing 1 for reducing the Electro Magnetic Interference (EMI) in the signal transmission. The gasket 5 is a rectangular frame and stamped from a metal sheet. The gasket 5 comprises a continuous periphery wall 50 consisting of a pair of opposite longitudinal edges 501 and a pair of side edges 502 respectively connecting with the longitudinal edges 501. The gasket 5 also defines a space 51 circumscribed by the periphery wall 50. A plurality of tubers 52, served as holding means, are spaced arranged on inner edge of the periphery wall 50 and all extend toward the space 51. A plurality of first spring fingers 503 are stamped corresponding to the tubers 52 formed on the longitudinal edges 501. Each side edge 502 is formed with a pair of second spring fingers 504 respectively extending toward each other from opposite upper and lower edges thereof. The tubers 52 are respectively received in the splits 16 of the housing 1 for retaining the gasket 5 in the housing 1. The first and second spring fingers 503, 504 are served as contacting means for elastically engaging with a conductive panel to which the complementary connector is mounted for grounding and reducing EMI.

A cable assembly 200 of the second embodiment of the present invention is illustrated in FIGS. 15-18. The difference between the cable assemblies 100, 200 exists in the latch mechanisms 3, 3'. Thus, the description of the same members is omitted here and some same members are omitted in the drawing figures.

Figure 15:
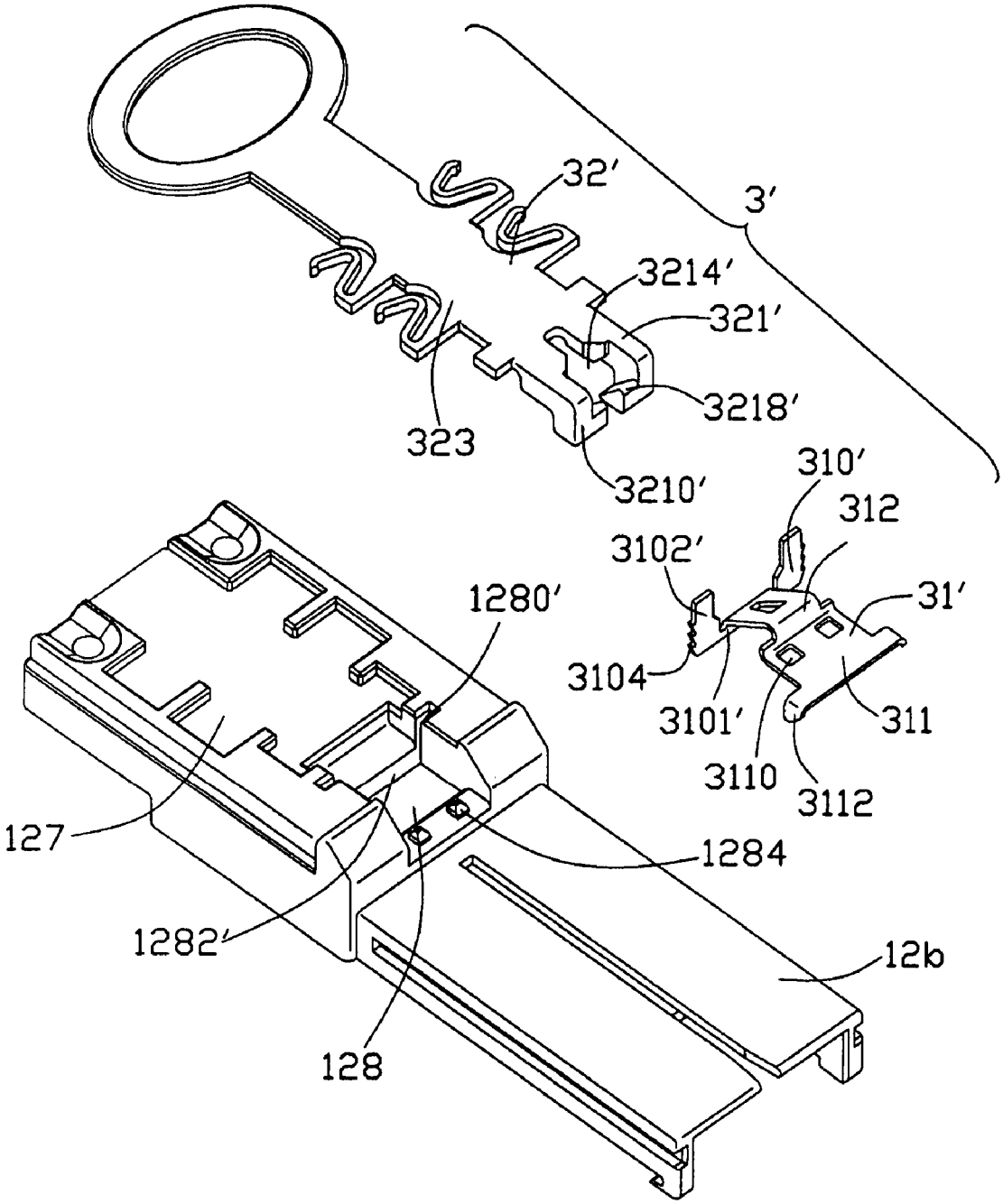
FIG. 15 is partially exploded, perspective view of the plug connector in accordance with the second embodiment of the present invention.
Figure 16:
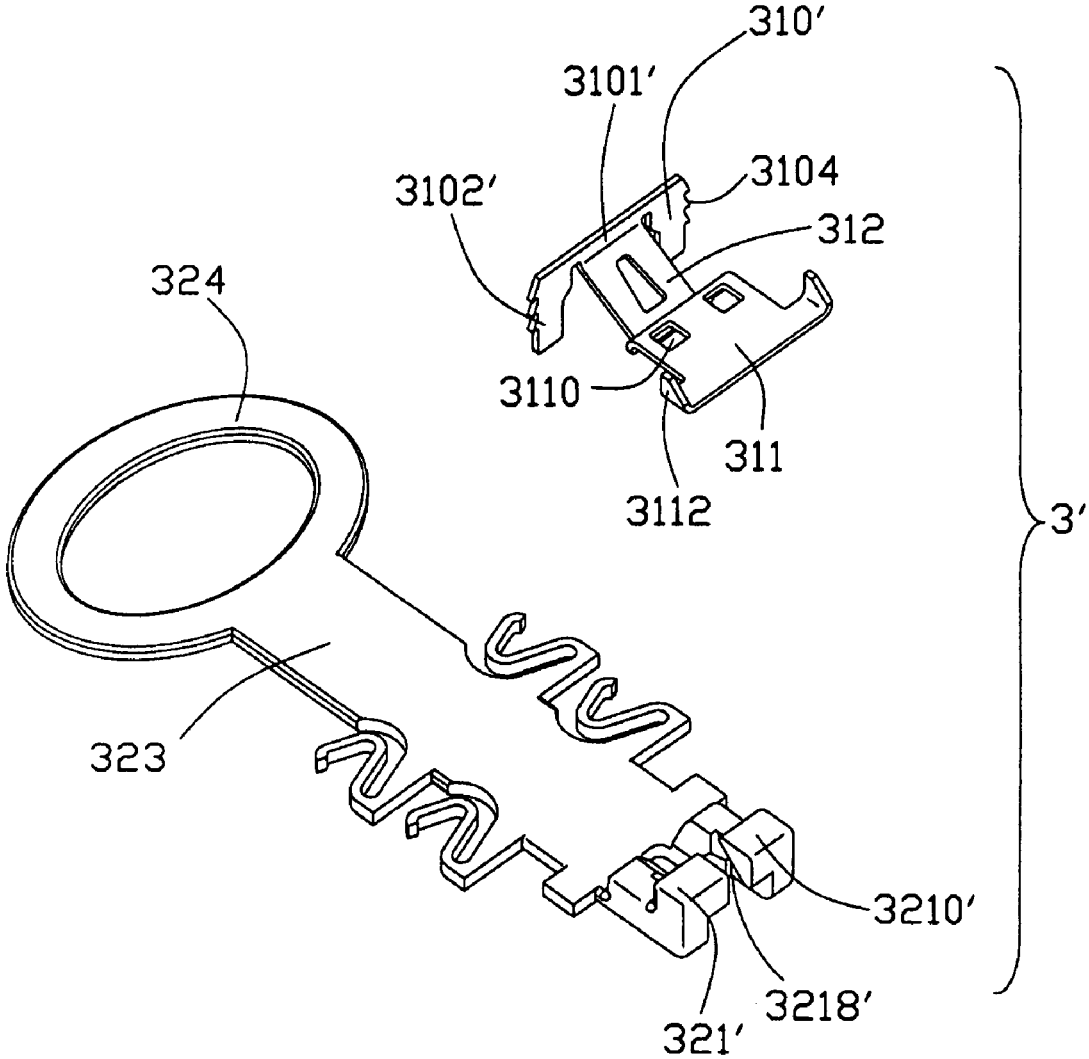
FIG. 16 an exploded view of a latch mechanism of the second embodiment.

Referring to FIGS. 15-16, the latch mechanism 3' of the cable assembly 200 has the substantially same structure as that of the latch mechanism 3 of the cable assembly 100. The latch mechanism 3' also comprises a latch member 31' and an actuating member 32' cooperating with the latch member 31'. The latch member 31' comprises a U-shape engaging portion 310' located in a vertical surface, the flat latching portion 311 located in a horizontal surface perpendicular to the vertical surface and the inclined connecting portion 312 connecting the engaging portion 310' with the latching portion 311. The latching portion 311 and the connecting portion 312 have the same structures as those of the latch member 31. Compared with the engaging portion 310, the engaging portion 310' comprises a transverse bar section 3101' and a pair of side sections 3102' extending upwardly from opposite sides of the bar section 3101'. The connecting portion 312 extends upwardly from an upper edge of the middle portion of the bar section 3101'.

The actuating member 32' also has the substantially same structure as that of the actuating member 32 except the cooperating portion 321'. The cooperating portion 321' of the second embodiment extends flatly from the intermediate portion 323 and forms a pair of downwardly-extending protruding sections 3210' at tip end thereof. The cooperating portion 321' is partially cut to form a pair of slanted surfaces 3218' on the protruding sections 3210' and a receiving area 3214' to receive a corresponding portion of the latch member 31'.

Corresponding to the structure changes of the latch member 31', the second base section 12*a* of the cover 12 forms a pair of vertical slits 1280' perpendicular to the second recess section 128 and forms a step 1282' corresponding to the position of the slits 1280'.

Figure 17:
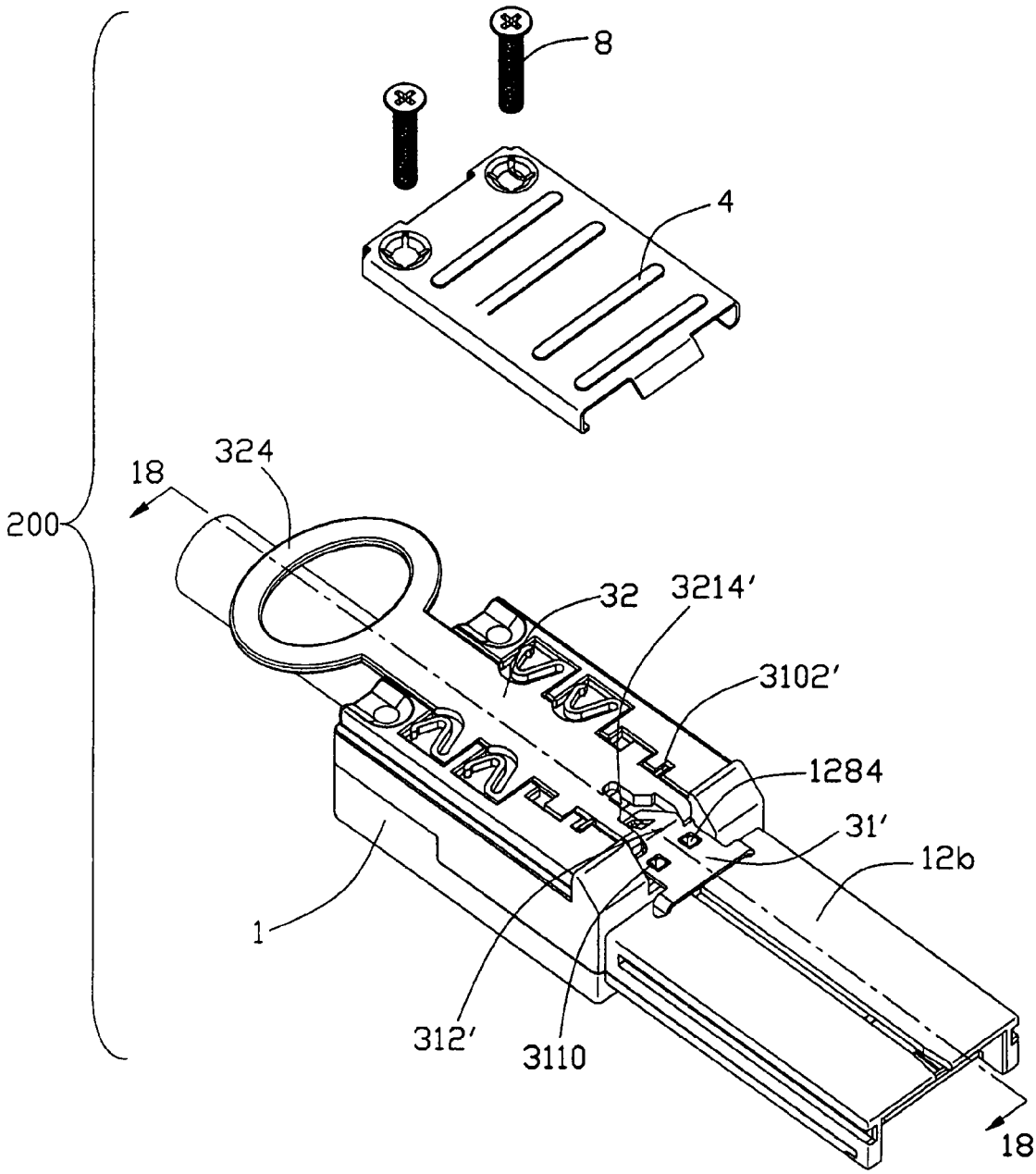
FIG. 17 is a partially assembled view of the plug connector of the second embodiment.
Figure 18:
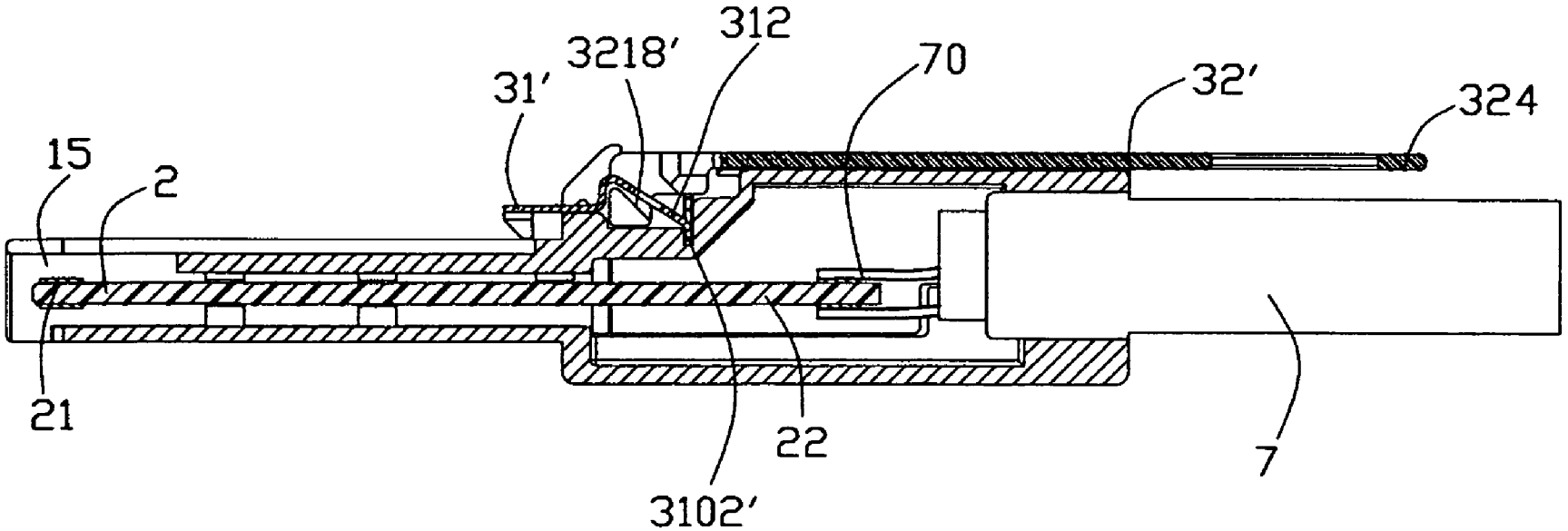
FIG. 18 is a cross-section view taken along line 18-18 of FIG. 17.

In assembly (the assembly of other same members are omitted here), referring to FIGS. 17-18, the latch member 31' is planted to the housing 1 in the vertical direction and received in the second recess section 128. The pair of side sections 3102' of the engaging portion 310 are respectively interferentially received in the slits 1280' by the barbs 3104 formed thereon and the bar section 3101' abut against the front surface of the step 1282'. The projections 1284 of the cover 12 are received in corresponding rectangular holes 3110 with the latch section 311 exposed above the second tongue section 12*b*. The actuating member 32' is assembled to the housing 1 and the latch member 31' first in a front-to-back direction to let the cooperating portion 321' locate below the connecting portion 312 of the latch member 31' and in the second recess section 128, then in the vertical direction to press other portions of the actuating member 4 to be received in the first recess section 127 of the housing 1 (same as in the first embodiment, omitted here). The connecting portion 312 is received in the receiving area 3214' of the actuating member 32'. As to disengage the cable assembly 200 from the complementary connector, a rearward pulling force is exerted to the pulling portion 324 of the actuating member 32'. The slanted surfaces 3218' of the cooperating portion 321' slide along the inclined connecting portion 312 of the latch member 31' until the protruding sections 3210' abuts against the bar section 3101' of the latch member 31' to actuate the connecting portion 312 to pivot upwardly relative to the bar section 3101' of the engaging portion 310' and the latch section 311 with the latches 3112 to upwardly move to disengage from the complementary connector. The pair of vertical walls forming the second recess section 128 prevents the pair of protruding sections 3210' of the cooperating portion 321' from moving outwardly when the actuating member 32' is pulled rearward.

Referring to FIGS. 19-22, a plug connector 300 in accordance with the third embodiment of the present invention is illustrated. The latch mechanism 3" of the plug connector 300 also comprises a latch member 31" and an actuating member 32" cooperating with the latch member 31". Same members and structure description are omitted in the specification and in the drawing figures.

Figure 19:
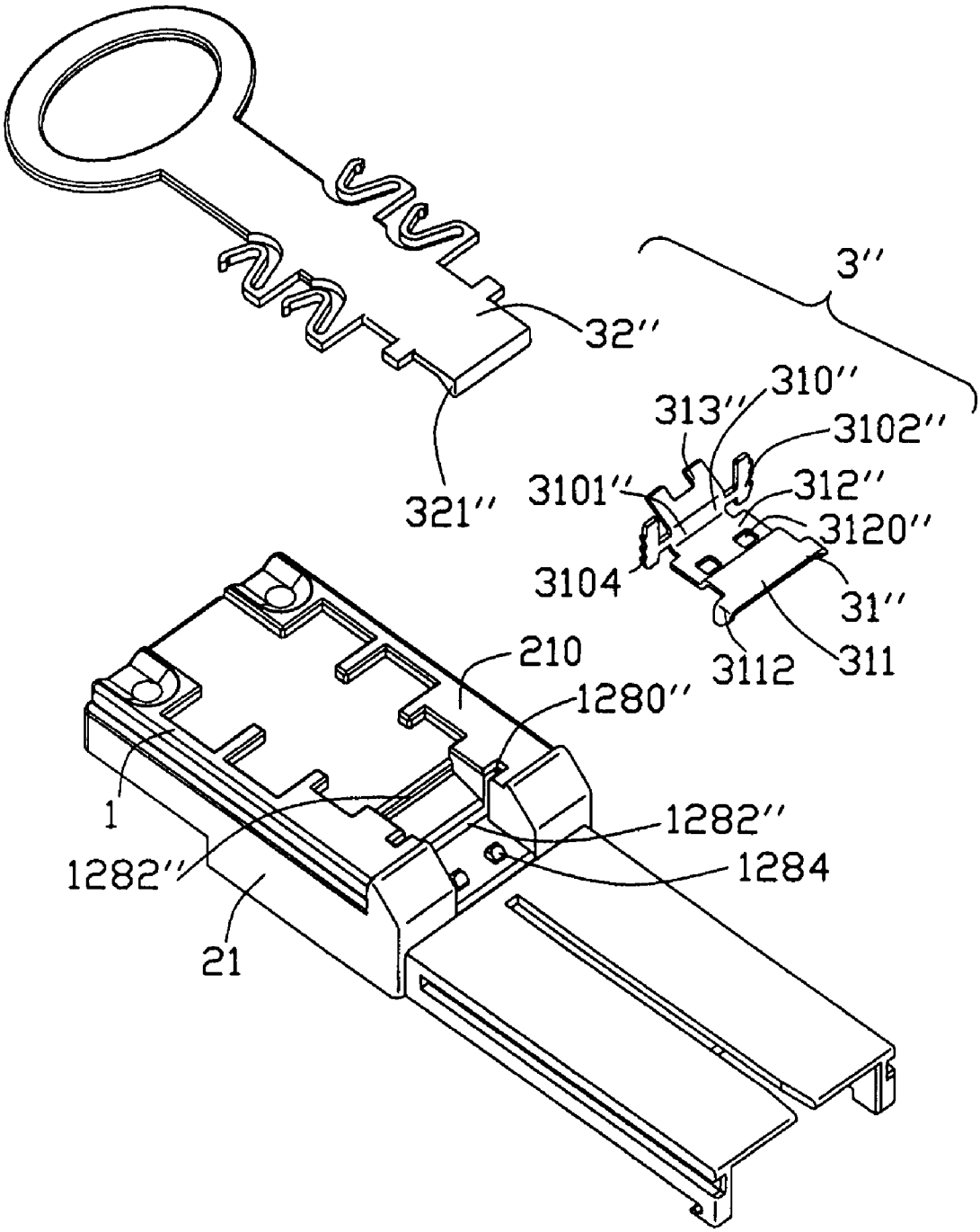
FIG. 19 is a partially exploded, perspective view of the plug connector in accordance with the third embodiment of the present invention.
Figure 20:
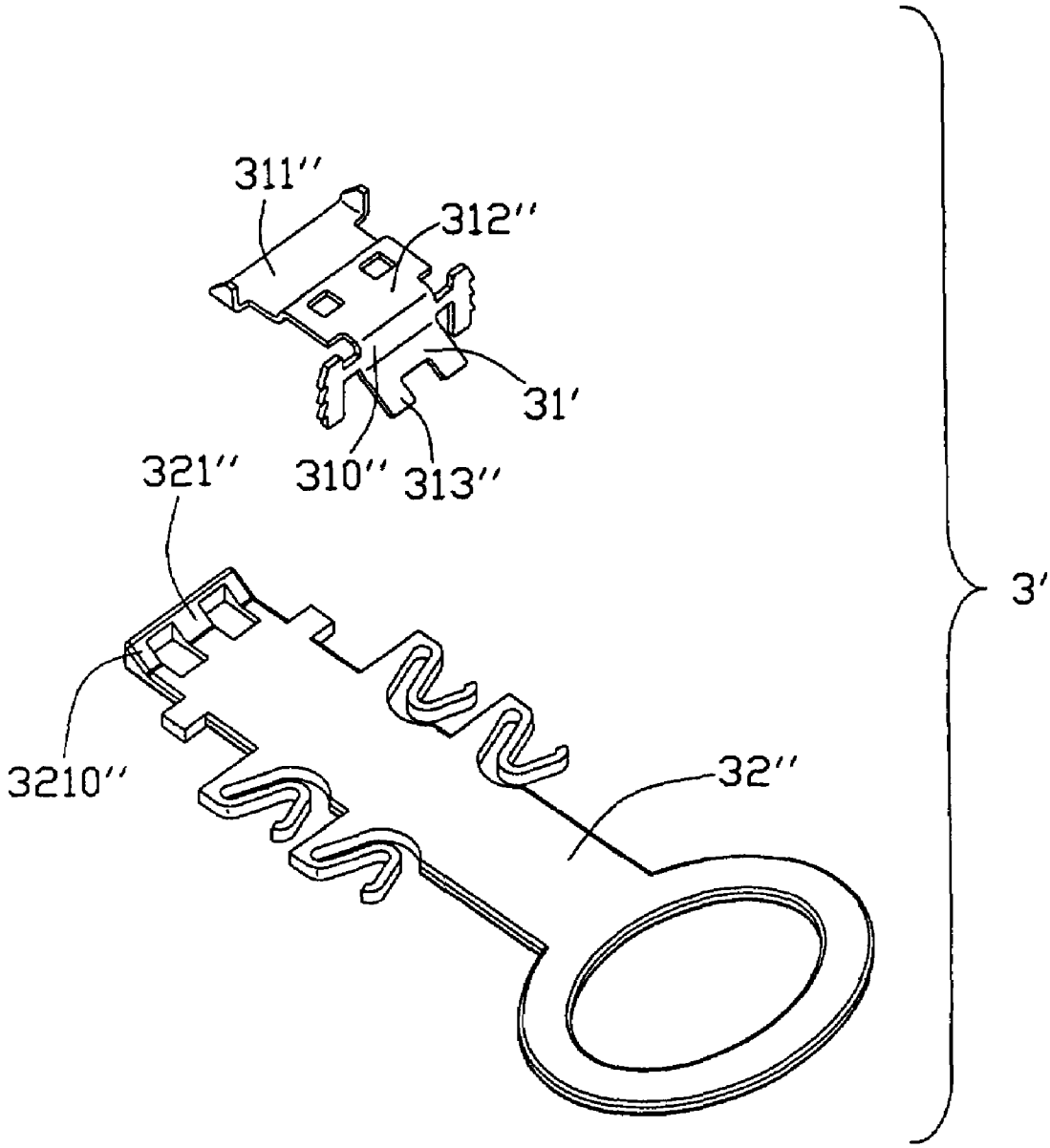
FIG. 20 is an exploded view of a latch mechanism of the third embodiment.
Figure 21:
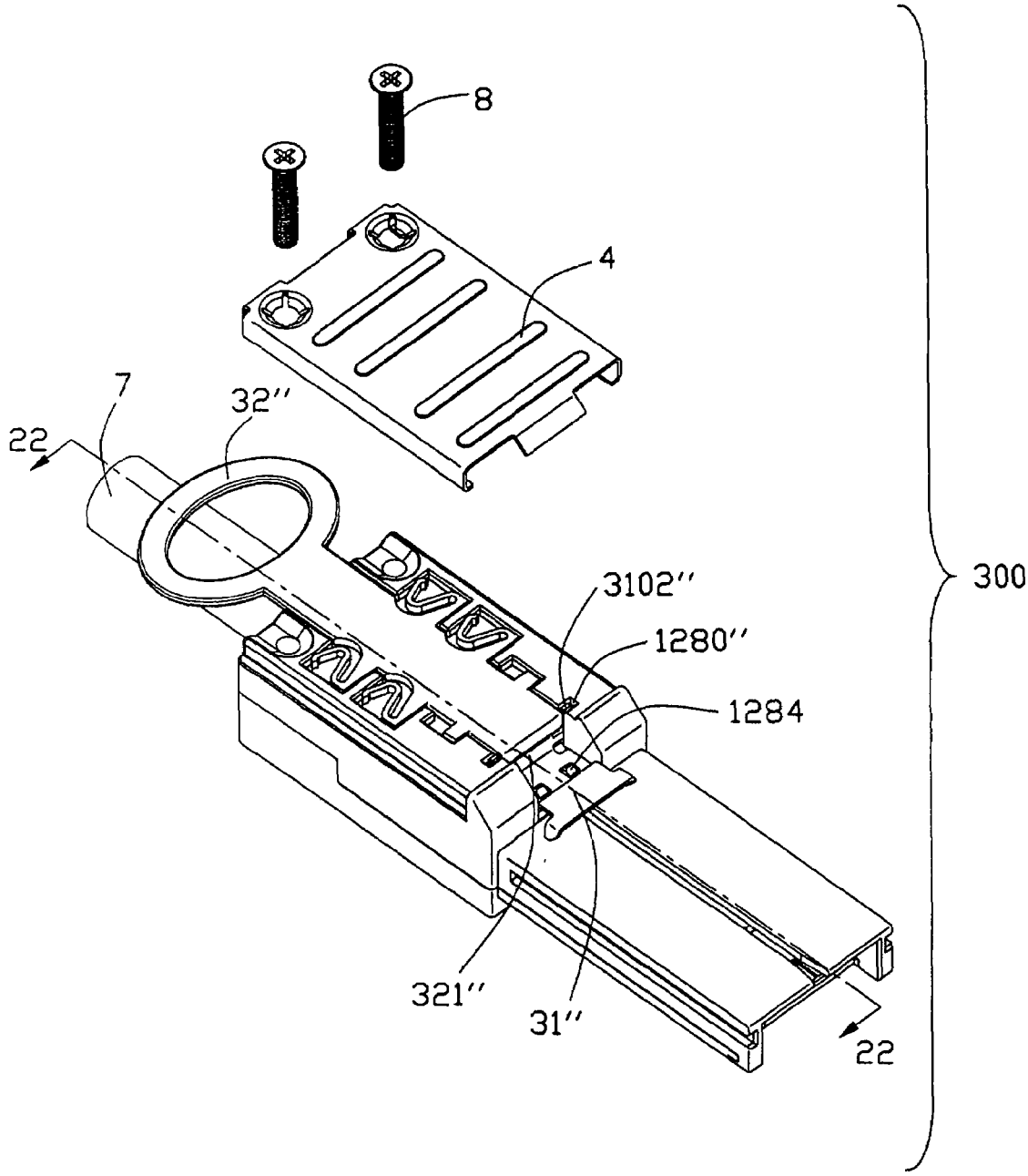
FIG. 21 is a partially assembled view of the plug connector in accordance with the third embodiment.
Figure 22:
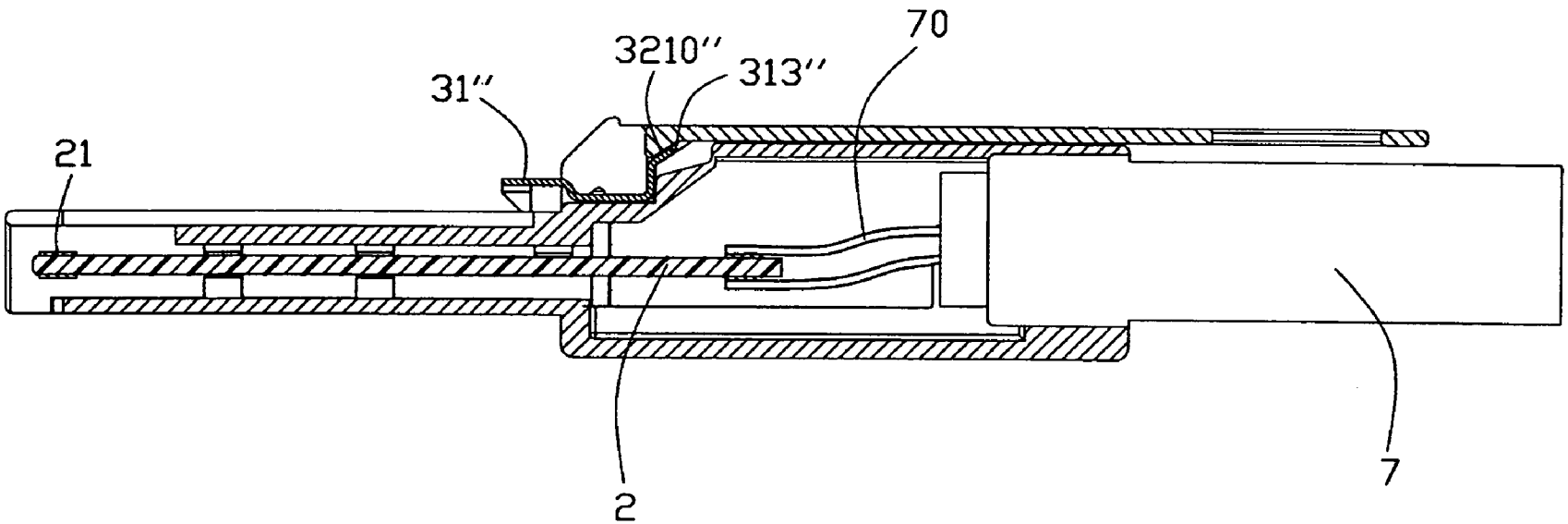
FIG. 22 is a cross-section view taken along line 22-22 of FIG. 21.

Referring to FIGS. 19-20, tip end of the cooperating portion 321" of the actuating member 32" is enlarged and forms an inclined surface 3210" for latching with the latch member 31".

The latch member 31" comprises a flat connecting portion 312" formed with a pair of rectangular holes 3120", a latch section 311' upwardly then flatly extending from a front edge of the connecting portion 312", an H-shape engaging portion 310" vertically extending from a rear edge of the connecting portion 312", and an inclined portion 313' upwardly and rearward extending from a middle of the engaging portion 310". The engaging portion 310" comprises a pair of vertically-extending side sections 3102" and a transversely-extending bar section 3101" connecting with lower portions of the side sections 3102".

In assembly, the latch member 31" is assembled to the housing 1", which has the same structure as the housing 1' of the second embodiment, in the vertical direction and received in the second recess section 128. The side sections 3102" are interferentially received in the slits 1280" via the barbs 3104 formed thereon and the bar section 3101" abuts against the step 1282" in the second recess section 128. The projections 1284 of the housing 1" are received in the rectangular holes 3120" of the connecting portion 312" and the latch portion 311 with the latches 3112 exposed above the second tongue section 12*b*. The actuating member 32" is assembled to the housing 1" and the latch member 31" in the vertical direction. The inclined surface 3210" of the cooperating portion 321" presses on the slanted portion 313" with other portions of the actuating member 32" received in the first recess section 127 as described in the first embodiment.

When to disengage the plug connector 300 from the complementary connector, a rearward pulling force is exerted to the pulling portion 324 of the actuating member 32", the inclined surface 3210" of the cooperating portion 321" rearward moves and slides along the slanted surface of the slanted portion 313" of the latch member 31". With the pivotal downward movement of the slanted portion 313" relative to the bar section 3101" of the engaging portion 310", the latch portion 311 moves pivotally upwardly relative to the bar section 3101" to disengage from the complementary connector.

Figure 23:
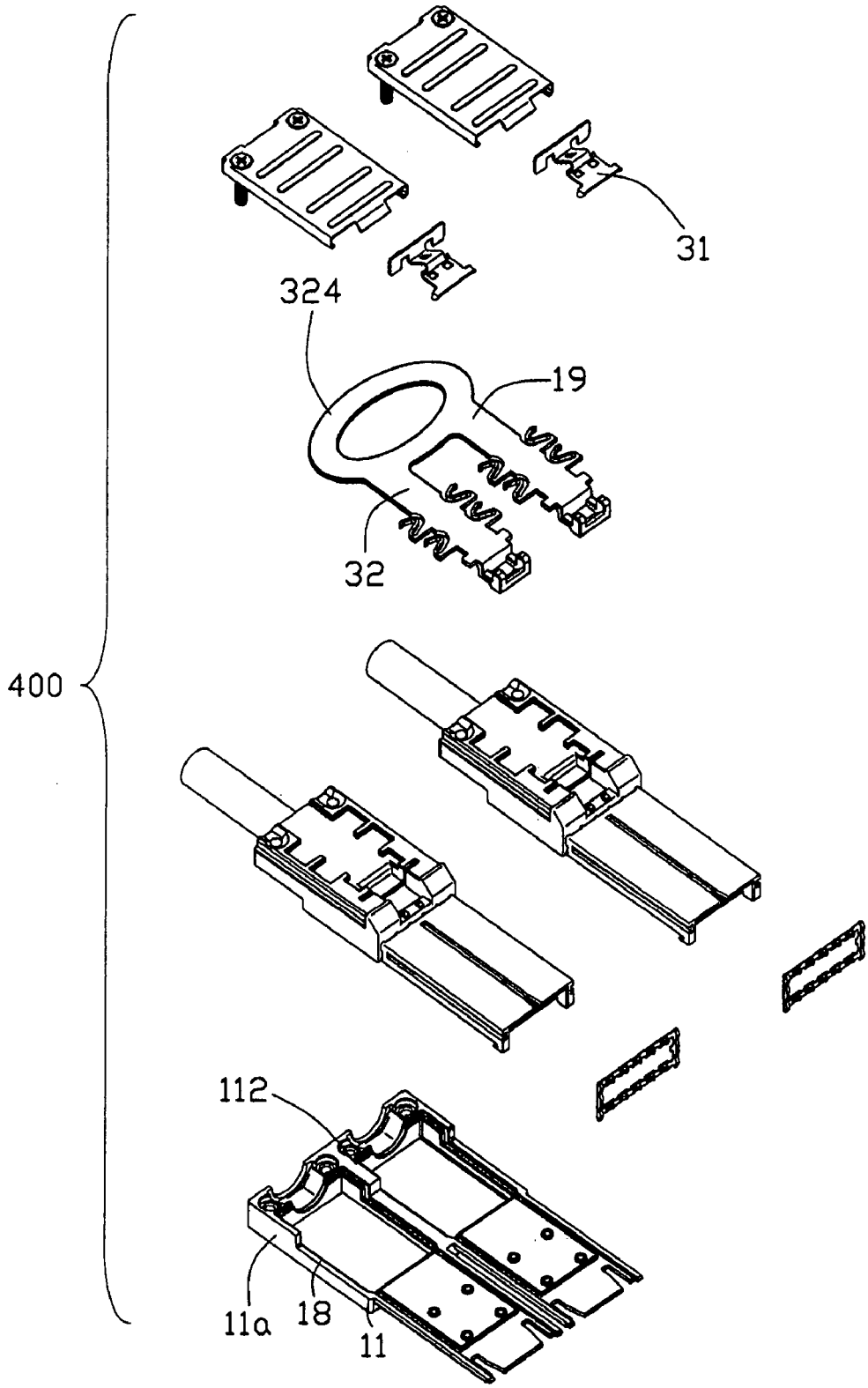
FIG. 23 is an exploded, perspective view of a plug connector in accordance with the forth embodiment of the present invention.
Figure 24:
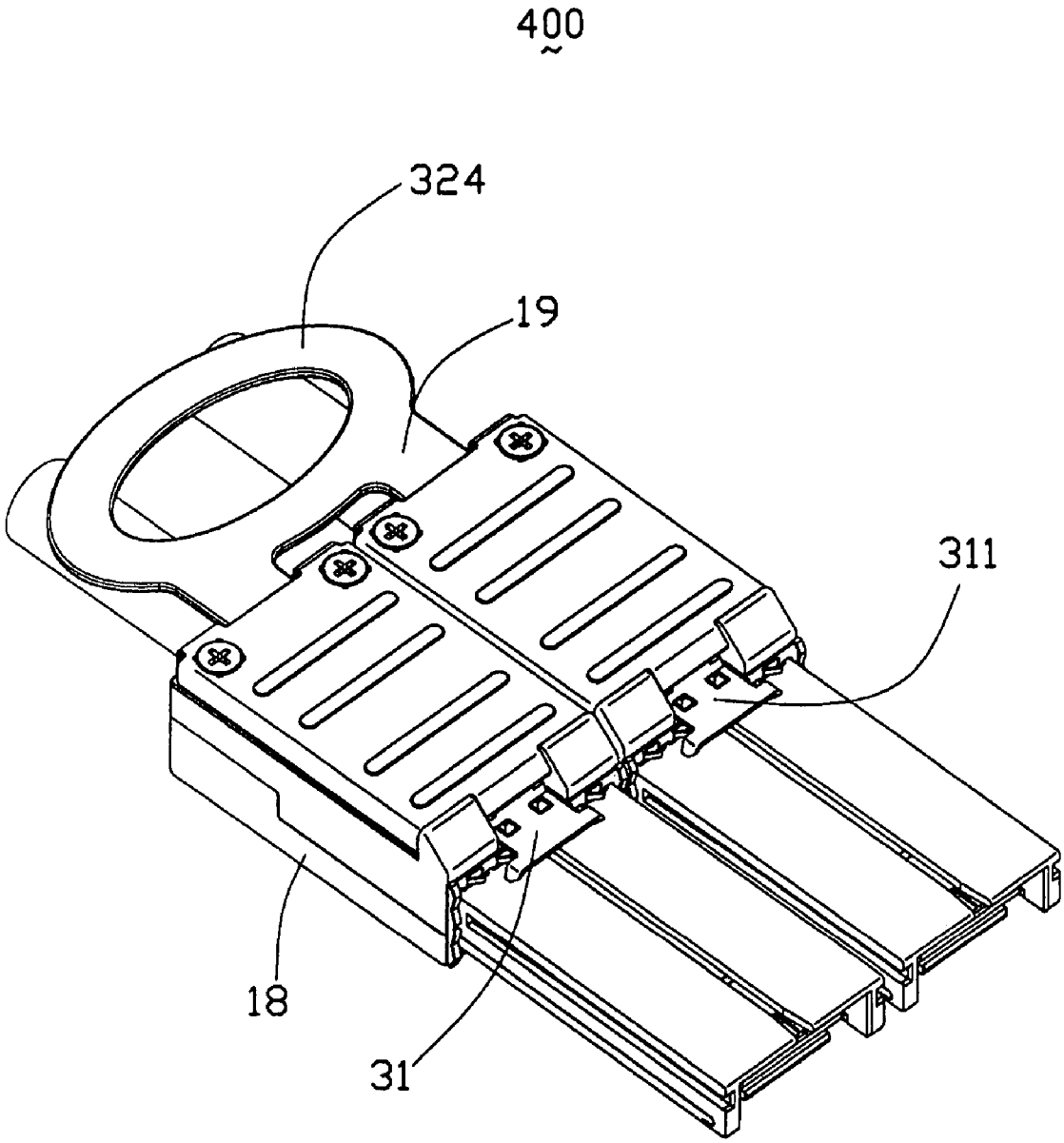
FIG. 24 is an assembled view of the plug connector of FIG. 23.

FIGS. 23-25 shows the forth embodiment of the present invention. The assembly 400 of the forth embodiment comprises a pair of cable connector assemblies juxtaposed arranged, each plug connector has the same structure as that of the plug connector 100 of the first embodiment. Of course, the cable connector assemblies 200, 300 also can be juxtaposed arranged. The assembly 400 integrates a pair of bases 11 into a base portion 18 and integrates a pair of actuating members 32 into a pulling part 19. The first flanges 112 of the pair of bases 11 are integrated together and the pair of actuating members 32 uses a common operating portion 324 which integrates the pair of actuating members 22 together. The assembly process is same as that of the cable assembly 100 of the first embodiment and is omitted here. To disengage the assembly 400 from the complementary connector, a rearward pulling force is exerted to the common operating portion

324 to actuate upward movement of the pair of latch sections 311 of the latch members 31, thus, the assembly 400 disengages from the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector mounted to a panel, comprising:

a housing comprising a base portion and a tongue portion extending forwardly from the base portion, the tongue portion having a first surface and being sized to fit within the complementary connector, the base portion having a second surface disposed at a level on the housing that is above the first surface of the tongue portion;

a latch member comprising an engaging portion attached to the second surface of the base portion and a latching portion extending beyond the base portion and located above the first surface of the tongue portion; and an actuating member having an operating portion extending beyond said base portion, a cooperating portion disposed between the latch member and said second surface of the base portion, and an intermediate portion interconnecting the operating portion and the cooperating portion, said actuating member being sized, structured and arranged such that movement of said actuating member away and toward said tongue portion caused the latching portion of the latch member to be raised and lowered relative to the first surface of the tongue portion; and wherein the intermediate portion of the actuating member has a portion being sized, structured and arranged such that movement of the actuating member away and toward said tongue portion causing the portion of the intermediate portion to be compressed by the base portion and to provide elastic restoring force to the latching member.

2. The plug connector as claimed in claim 1, wherein said engaging portion of the latch member is located in a surface perpendicular to said second surface of the base portion.

3. The plug connector as claimed in claim 1, wherein said engaging portion of the latch member is located in a position adjacent to the tongue portion.

4. The plug connector as claimed in claim 1, wherein said latch member is operated in a lever manner.

5. The plug connector as claimed in claim 1, wherein the engaging portion of the latch member forms a slanted portion extending rearward and upwardly, and wherein the cooperating portion of the actuating member forms a slanted surface attaching to the slanted portion of the latch member and capable of sliding along the slanted portion to actuate the slanted portion to downwardly move relative to the engaging portion and the latch portion upwardly move for unlatching from the complementary connector.

6. The plug connector as claimed in claim 1, further comprising a PCB comprising a rear end received in the base portion and formed with a plurality of second conductive pads, and a front end engaging with the tongue portion and formed with a plurality of first conductive pads adapted for mating with the complementary connector.

7. The plug connector as claimed in claim 1, further comprising a conductive shell assembled to the base portion of the housing and partially covering the actuating member.

8. The plug connector as claimed in claim 1, further comprising an EMI gasket mounted to one of the base portion and the tongue portion of the housing adapted for contacting with said panel.

9. The plug connector as claimed in claim 1, wherein the portion of the intermediate portion is a pair of elastic sections formed therewith, and wherein the second surface of the base portion defines a pair of recesses recessed downwardly therefrom and receiving the elastic sections.

10. The plug connector as claimed in claim 9, wherein each elastic section comprises a transverse block section and a spring section, and wherein the block section and the spring section respectively abut against the opposite edges of corresponding recess.

11. The plug connector as claimed in claim 9, further comprising a cable comprising a plurality of conductors electrically connecting with the second conductive pads.

12. The plug connector as claimed in claim 1, wherein the latch member forms an inclined connecting portion connecting the engaging portion with the latch portion, and wherein the cooperating portion of the actuating member forms a slanted surface attaching to connecting portion of the latch member and capable of sliding along the connecting portion to actuate the connecting portion to downwardly move relative to the engaging portion and the latch portion upwardly move for unlatching from the complementary connector.

13. The plug connector as claimed in claim 12, wherein the cooperating portion forms a protrusion adjacent to the slanted surface, and wherein the protrusion abuts against the engaging portion with the rearward movement of the actuating member to prevent the actuating member from disengaging from the latch member.

14. A plug connector adapted for mating with a complementary connector, comprising:

a housing comprising a base portion and a tongue portion extending forwardly from the base portion, the tongue portion having a first surface and being sized to fit within the complementary connector, the base portion having a second surface disposed at a level on the housing that is above the first surface of the tongue portion;

a PCB received in the housing and comprising a front end engaged with the tongue portion and a rear end received in the base portion;

a cable comprising a plurality of conductors electrically connecting with the rear end of the PCB;

a latch member comprising a latch member comprising an engaging portion attached to the second surface of the base portion and a latching portion extending beyond the base portion and located above the first surface of the tongue portion; and an actuating member having an operating portion extending beyond said base portion, a cooperating portion disposed between the latch member and said second surface of the base portion, and an intermediate portion interconnecting the operating portion and the cooperating portion, said actuating member being sized, structured and arranged such that movement of said actuating member away and toward said tongue portion caused the latching portion of the latch member to be raised and lowered relative to the first surface of the tongue portion; and wherein the intermediate portion of the actuating member has a pair of elastic sections being sized, structured and arranged such that movement of the actuating member away and toward said tongue portion causing the portion of the intermediate portion to be compressed by the base portion and to provide elastic restoring force to the latching member.

15. A plug connector comprising:

a housing having a circumferential step portion in a middle portion;

a grounding gasket assembled to said step portion;

a metallic shell assembled upon a top face of a rear portion of the housing;

a deflectable latch mechanism positioned around the middle portion;

an actuator protectively located between the metallic shell and the top face of the housing, said actuator defining a cooperation section engaged with the latch mechanism to urge the latch to move, an operation section exposed behind the housing for easy mutually operating the actuator, and an elastic section urging the actuator to be at a relaxed position where the latch mechanism is adapted to be locked to a corresponding complementary connector.

16. The plug connector as claimed in claim 15, wherein said elastic section is hidden under the shell.

17. The plug connector as claimed in claim 15, wherein said latch is constructed in a cantilever manner, and the cooperation section is protectively hidden under the shell while a latch section of the latch mechanism is exposed outside.

18. The plug connector as claimed in claim 15, wherein the elastic section includes two independent springs for assure elasticity thereof even if one of said two springs is broken.

19. The plug connector as claimed in claim 15, wherein a cable is connected to a printed circuit board which is horizontally located in the housing.

20. The plug connector as claimed in claim 17, wherein said cooperation section and a corresponding portion of the latch mechanism engaged with the cooperation section, are both obliquely extending along a front-to-back direction.

* * * * *